US009749741B1

(12) United States Patent
Yang et al.

(10) Patent No.: US 9,749,741 B1
(45) Date of Patent: Aug. 29, 2017

(54) SYSTEMS AND METHODS FOR REDUCING INTERMODULATION DISTORTION

(71) Applicant: Amazon Technologies, Inc., Seattle, WA (US)

(72) Inventors: Jun Yang, San Jose, CA (US); Colin Randall McEnroe, San Mateo, CA (US); Jian Guo, Sunnyvale, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 15/130,355

(22) Filed: Apr. 15, 2016

(51) Int. Cl.
*H04R 3/00* (2006.01)

(52) U.S. Cl.
CPC ..... *H04R 3/007* (2013.01); *H04R 3/005* (2013.01); *H04R 2430/01* (2013.01); *H04R 2430/03* (2013.01)

(58) Field of Classification Search
CPC .. H04N 7/18; H04N 7/64; H04Q 9/14; H04Q 2209/25; H04Q 2209/886; H04Q 9/00; H04R 2225/43; H04R 25/505; H04R 25/554; H04R 25/558; G10L 21/043; G10L 21/0208; G10L 19/018; G10L 25/78; G10L 19/008; G10L 21/02; G10L 25/93; G10L 19/012; G10L 19/0204; G10L 2025/932; G10L 2025/937; G10L 21/0205; G10L 21/0364; G10L 25/51; G10L 25/69
USPC .... 381/55–58, 17–23, 71.1–71.4, 94.1–94.5; 704/233, 226, 227
See application file for complete search history.

(56) References Cited

U.S. PATENT DOCUMENTS 6,606,391 B2 * 8/2003 Brennan ..... H03H 17/0266 381/312
6,621,906 B2 * 9/2003 Fukuchi ..... H04S 1/002 381/1
2006/0098827 A1 * 5/2006 Paddock ..... G10L 21/02 381/106
2006/0224381 A1 * 10/2006 Makinen ..... G10L 25/78 704/223
2007/0136056 A1 * 6/2007 Moogi ..... G10L 21/0208 704/227

* cited by examiner

*Primary Examiner* — Lun-See Lao
(74) *Attorney, Agent, or Firm* — Robert W. Morris; Eckert Seamans Cherin & Mellott, LLC

(57) ABSTRACT

Methods and devices for reducing intermodulation distortion are described herein. In response to receiving an audio input signal, N filtered audio signals may be generated by a filter bank, corresponding to N different frequency bands. The N filtered audio signals may be delayed by a delay time D, and a determination of whether an audio frame of the filtered audio signals includes an audio event or a non-audio event. A signal level estimation may then be determined, the signal level estimation indicating an expander, a compressor, or no compression effects being present. An amount of gain is determined and applied to the delayed audio signals, which are summed across the N frequency bands to generate a full-band audio signal. In some embodiments, the full-band audio signal may be applied to a limiter to reduce any audio clipping, and a final audio signal may be generated.

20 Claims, 11 Drawing Sheets

SYSTEMS AND METHODS FOR REDUCING INTERMODULATION DISTORTION

BACKGROUND

Dynamics processors, though widely used in various signal processing applications, can cause unwanted compression in various frequency bands due to an audio input signal of a different frequency band, otherwise referred to as intermodulation distortion ("IM"). Such IM reduces the overall quality of an electronic device's audio output as additional audio signals are formed at harmonic frequencies of the audio input signal's frequency band, as well at non-linearly related frequencies.

DETAILED DESCRIPTION

Figure 1A:
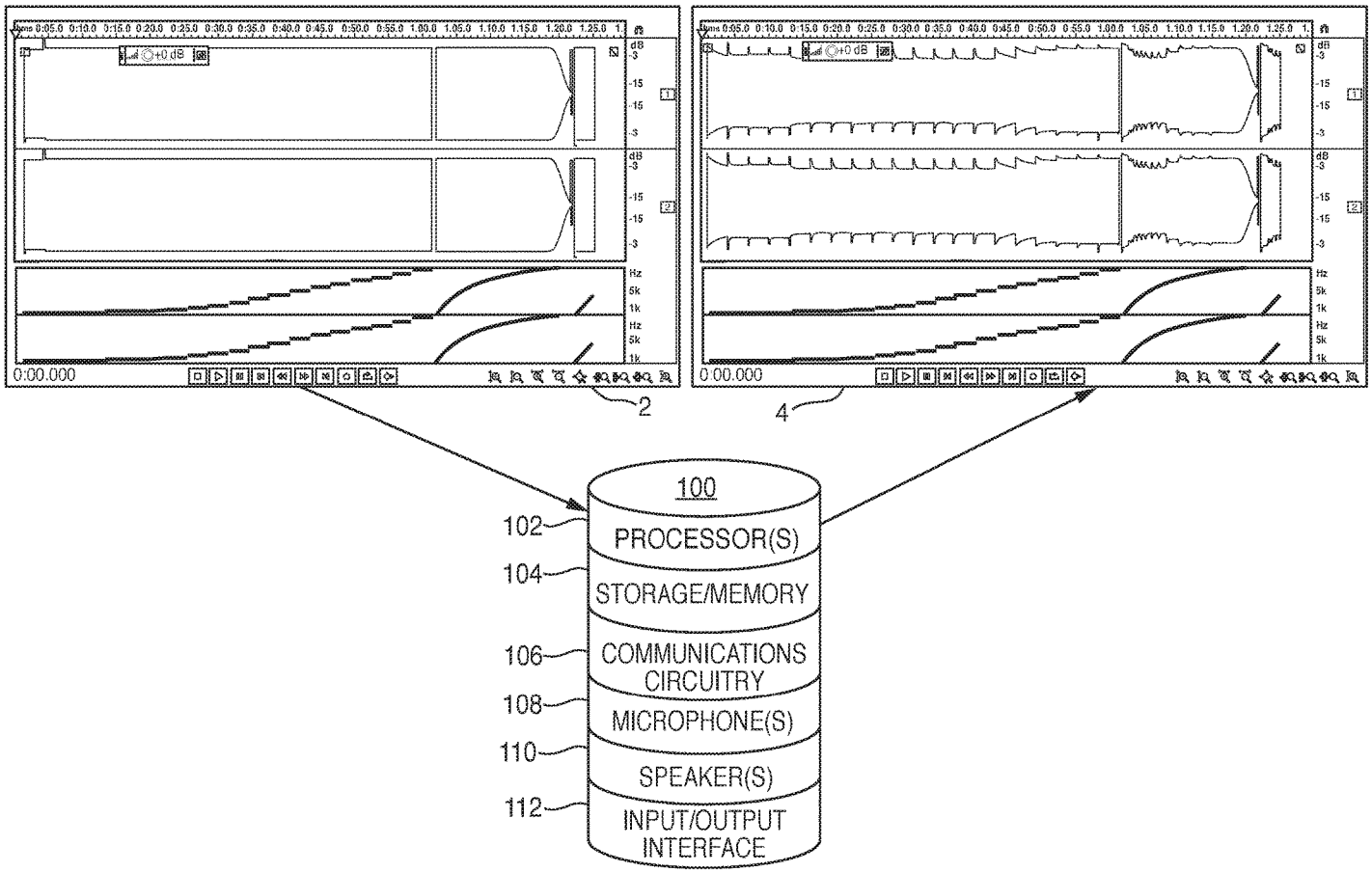
FIGS. 1A and 1B are illustrative diagrams of an audio input signal and an audio output signal from an electronic device with IM and without IM, respectively, in accordance with various embodiments.

The present disclosure, as set forth below, is generally directed to various embodiments of systems and methods for reducing the effects of intermodulation distortion ("IM") for electronic devices. Dynamics processors are a common type of processor employed by signal processing devices. Such signal processing devices including dynamics processors generally have increased output sound quality due to the dynamics processors wide range of capabilities. For example, dynamics processors are capable of, amongst other features, increasing an apparent loudness of audio output, improving a quality of audio output, adding punch or attack to vocal tracks, increasing sustain for cymbal sounds, and reducing background noises.

In wideband frequency applications, however, dynamics processors may generate unwanted intermodulation distortion ("IM") at certain frequency bands. An audio input signal provided to an electronic device utilizing a dynamics processor may produce additional signal content at other frequencies linearly and non-linearly related to the audio input signal's frequencies. For example, an audio input signal including two frequencies, $f_1$ and $f_2$, may produce harmonics of the audio input signal produced at multiples of either or both frequency. For instance, harmonics at $2f_1$ and $2f_2$, $3f_1$ and $3f_2$, and so on, may be produced, as well as higher-order distortions. In some embodiments, second-order distortion at frequencies $f_1-f_2$ and $f_1+f_2$, and even third-order distortions at various other frequencies, such as $2f_1-f_2$, $2f_2-f_1$, $2f_1+f_2$, and $2f_2+f_1$, may also be produced. The extra signals produced at such higher-order frequencies can lead to a decrease in the overall audio output signal's quality. This is further exacerbated, as mentioned previously, for wideband signals, where the number of frequency bands of the audio input signal may be much large than two (e.g., two frequencies, four frequencies, eight frequencies, etc.).

Furthermore, in some embodiments, a dynamics processor may need to be prevented from being triggered by one or more frequencies of an input signal. Certain multi-band dynamics processor applications may, therefore, cause unwanted signal artifacts and overshoots in the audio output signal. Thus, some multi-band dynamics processors may generally output audio that has low, or poor, frequency resolution.

To reduce the effects of such IM associated with multi-band dynamics processors, a multi-band dynamics processor ("MBDP") system may be employed to reduce or increase a level of one or more frequency bands in response to the dynamics in that frequency band exceeding, or falling beneath, a certain threshold level. The MBDP system may be implemented for any number of channels including, but not limited to, mono systems, stereo systems, 5.1 channel systems, 7.1 channels systems, or even systems with a larger number of channels. Such MBDP systems may be useful for a large variety of applications including, but not limited to, vocal processing, dynamics equalizers ("EQ"), and/or loudest audio generators.

In some embodiments, a full-band audio input signal (e.g., an audio signal including multiple frequency bands) may, for instance, be provided to a filter bank of a mono MBDP system. The filter bank may be configured such that it splits the full-band audio input signal into N-frequency bands, where N is an integer (e.g., N=2, 3, 4, etc.). Depending on the number of frequency bands that the filter bank splits the audio input signal into, a corresponding number of filtered audio signals may be generated as outputs of the filter bank. Each of the filtered audio signals, therefore, may be associated with one of the frequency bands. For example, if the filter bank splits the full-band audio input signal into three bands, then three filtered audio signals will be generated: a first filtered audio signal of a first frequency band, a second filtered audio signal of a second frequency band, and a third filtered audio signal of a third frequency band.

A delayed audio signal may be generated for each filtered audio signal by delaying each filtered audio signal by a delay time. The delay time, for example, may only be a few samples long, or in other words a few milliseconds. A determination may then be made as to whether one or more of the filtered audio signals include an audio event, such as speech or music, as opposed to a non-audio event, such as silence or noise. In some embodiments, this determination may be done by providing each filtered audio signal a signal event detector module. The signal event detector module may be configured to determine a frame energy, an energy envelope, and an energy floor, or lower bound of the energy envelope, for each audio frame of each filtered audio signal. The audio frames may each have a frame length that is associated with an audio sampling rate. In some embodiments, if the energy envelope is greater than a product of the energy floor and an energy ratio threshold value, then that audio frame likely includes an audio event. The energy ratio threshold value may correspond to a user adjustable constant that, when multiplied by the energy floor, indicates a lower limit of an audio frame's energy that is indicative of speech, voice, sound, or any other audio event. Non-audio events, such as silence or noise may correspond to an audio frame's energy that is less than the energy floor multiplied by energy ratio threshold value. The frame energy for this particular audio frame may then be used to determine an audio signal level estimation. However, if the energy envelope is less than the product of the energy floor and the energy ratio threshold value, then that audio frame includes a non-audio event. Furthermore, using the frame energy for the audio frame, a signal level estimation of the audio signal may be determined by a signal level estimation module.

The audio signal level estimation may be used to determine an adaptive audio gain amount to apply to boost or cut the audio input signal of a particular frequency regime. In some embodiments, the audio signal level estimation may first be converted from the linear domain to a logarithmic domain, thereby generating a logarithmic representation of the audio signal level estimation. The adaptive audio gain may generally be expressed in units of decibels ("dB"), therefore conversion of the audio signal level to the logarithmic domain may be needed. Decibels typically indicate an intensity or pressure of a sound. Louder sounds which are more intense typically have a larger value in decibels, whereas quieter sounds that are less intense typically have smaller values in decibels. To convert from the linear domain to the logarithmic domain, a base unit, such as base 10, base 2, or base e, where e is Euler's number, may be set. Then a ratio of a sound, such as a sound that is to be converted into units of decibels, and a threshold sound, such as the standard threshold of hearing $I_0=10^{-12}$ Watts/m$^2$, may be determined. If, for example, the sound to be converted is 10,000 times louder than $I_0$ then, in base 10, then the logarithmic value of 10,000 would be 4, and so the sound would be 40 dB. In other words, the intensity of the sound is 10,000, or $10^4$ times more intense than $I_0$. If the logarithmic representation of the audio signal level estimate is less than a first threshold value, then this may correspond to an expander case. If the logarithmic representation of the audio signal level estimation is instead greater than a second threshold, then this may correspond to a compressor case. If, however, the logarithmic representation of the audio signal level estimate is less than or equal to the second threshold, but greater than or equal to the first threshold, then this may correspond to neither an expander or compressor case, but a situation where no compression may be needed. The adaptive audio gain amount, therefore, varies depending on whether the expander case, compressor case, or no compression case is applicable.

After the appropriate amount of adaptive audio gain is determined, a gain smoothing module may apply an appropriate amount of gain smoothing to a corresponding delayed audio signal, thereby generated a processed audio signal. The appropriate amount of adaptive gain, for example, may be determined based on the amount of adaptive audio gain along with a gain smoothing factor. The gain smoothing factor may correspond to a time constant that reduces any abrupt changes in the amount of adaptive gain applied to a signal such that the gain smoothing is less disjointed and has a more seamless transition. A similar process may be performed for each filtered audio signal, such that processed audio signals for each frequency band are generated having an appropriate amount of gain smoothing applied. The processed audio signals may then be summed across all frequency bands (e.g., N frequency bands) to generate a full-band output audio signal. In some embodiments, a limiter may also be applied after summing across all frequency bands to remove any audio clipping or overshoot effects for the full-band output audio signal.

For a stereo system, the initial audio input signal includes a left audio input signal and a right audio input signal. Each of the left audio input signal and right audio input signal may, therefore, be provided to separate filter banks, however both of the filter banks may be similarly configured such that both the left audio input signal and the right audio input signal are split into N filtered audio signals (e.g., N left filtered audio signals and N right filtered audio signals). For each of the N left filtered audio signals and N right filtered audio signals, a determination may therefore be made as to whether an audio frame of a filtered audio signal includes an audio event or a non-audio event therein. A signal level estimation may then be performed for that filtered audio signal's audio frame. After the audio signal level estimation is determined, the left filtered audio signal and right filtered audio signal for each respective frequency band may be combined using a weighted summation, and the weighted summation may be used to determine whether the audio signal level estimation corresponds to an expander case, a compressor case, or a no compression case.

Furthermore, in some embodiments, a decimation factor may be applied to reduce computational complexity, thereby reducing the amount of power needed to account for compression or expansion. A low-powered electronic device, such as a battery operated electronic device, may include a predefined sampling rate reduction factor to reduce a number of audio frames analyzed for audio events or non-audio events. For example, instead of analyzing every audio frame, every other audio frame, every third audio frame, or every M-th audio frame may be analyzed.

For vocal processing, a high quality microphone may capture sound, such as voice, including a large range of frequencies and dynamic fluctuations. Such captured voice may predominately be in the mid-range frequencies. Resonances of an individual's mouth and chest, for instance, may produce low frequency components as well as various high frequency components. All of these different frequency components give each voice its unique timbre and sound. By compressing such a vocal track, the mid-range frequencies may appear louder, while the higher and lower frequencies will lessen due to IM because the large amount of mid-range frequencies are triggering a wideband compressor, thereby pushing the entire audio signal level down. However, an MBDP system, such as described in greater detail below, may be employed to compress the mid-range frequencies separately, thereby preserving the low and high frequency components of the captured voice.

An equalizer may cut or boost various frequency components of an audio input signal by a constant amount without consideration of the dynamics or loudness fluctuations of the various frequency components of the audio input signal. Although combining some existing wideband compressors with an equalizer may account for such cuts or boosts to the various frequency components of the audio input signal, such combinations may also generate IM. As an illustrative example, vocal sounds corresponding to the letters "s" or "t" may include large amounts of high frequency energy between the 5 kHz and 8 kHz range. Using an equalizer in this frequency range may cut these high frequencies across an entire audio track regardless of whether or not the different portions of the audio track include utterances of an "s" or "t". The MBDP system described herein can work as a dynamic equalizer, which may be employed within a specific frequency range in some embodiments, such as between 5 kHz and 8 kHz, if these frequencies exceed a certain threshold level. If so, the MBDP system may push the corresponding high energy peaks down only when they are included within the audio track, thereby not modifying any other portion of the audio track. Furthermore, additional reduction to these high energy peaks may even be possible, beyond the potential of what equalizers may be capable of. Thus, in this scenario, the MBDP system may adaptively cut or boost certain frequency band levels with minimum IM and minimum overshoot in response to determining that a particular frequency band exceeds, or is less than, a certain threshold level.

For a loudest audio generator, a reduction in a peak-to-average level of an audio signal may increase an apparent volume of that audio signal. For example, the apparent loudness may be increased by several decibels ("dBs"). Previous wideband compressors, however, cause the "louder" frequency bands to receive more peak-to-average reduction as compared to the "softer" frequency bands, compromising the overall balance of the audio output signal. The MBDP system described herein may, therefore, allow the peak-to-average reduction of each frequency band to be controlled individually, thereby improving the overall audio output signal's quality.

Figure 1B:
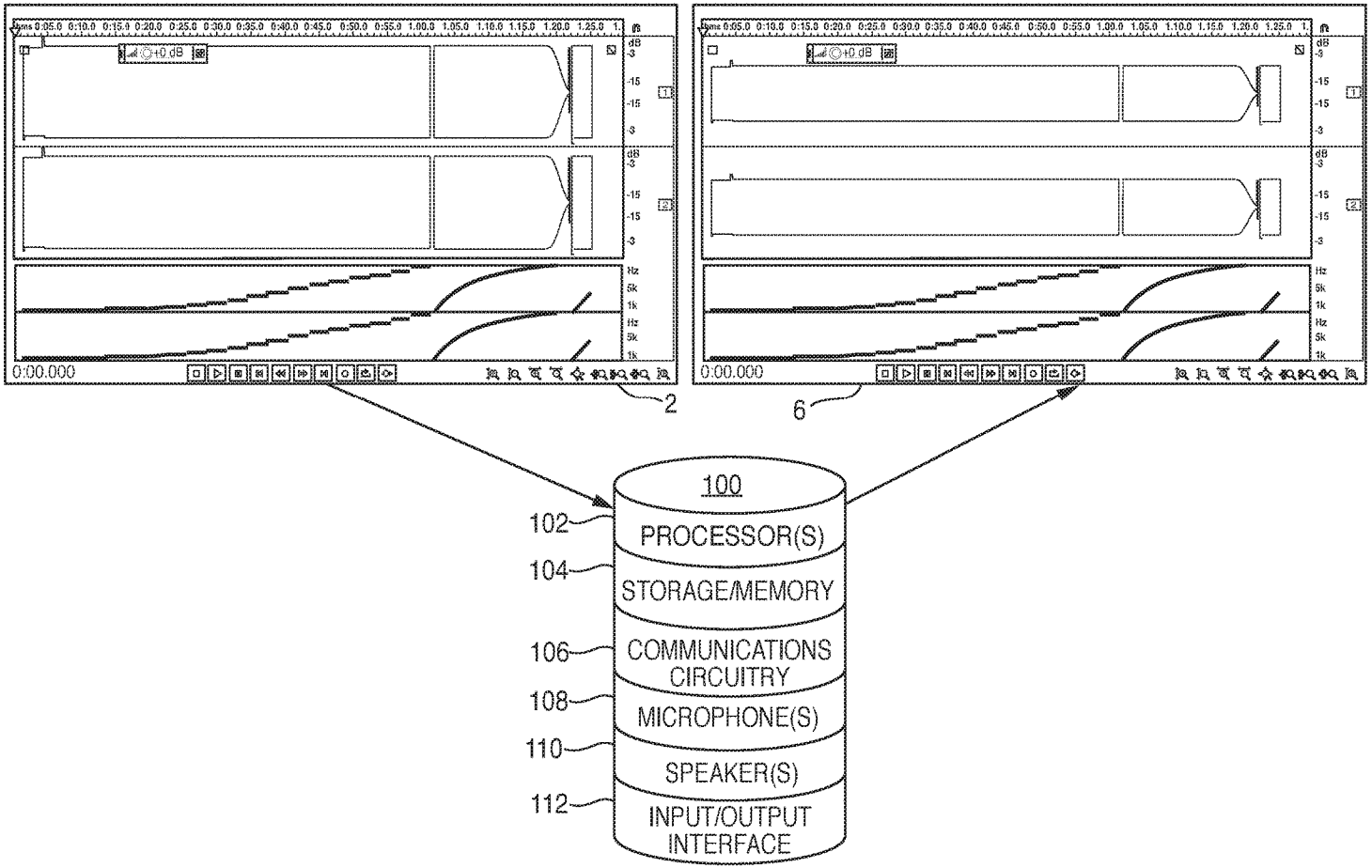

FIGS. 1A and 1B are illustrative diagrams of an audio input signal and an audio output signal from an electronic device with IM and without IM, respectively, in accordance with various embodiments. Electronic device 100, in some embodiments, may correspond to a sound controlled electronic device, such as a voice activated electronic device, or any other suitable electronic device capable of receiving an audio input signal 2 and outputting an audio output signal 4.

A sound controlled electronic device, as described herein, corresponds to any device capable of being activated in response to detection of a specific sound (e.g., a word, a phoneme, a phrase or grouping of words, or any other type of sound, or any series of temporally related sounds). For example, a voice activated electronic device is one type of sound controlled electronic device. Such voice activated electronic devices, for instance, are capable of obtaining and outputting audio data in response detecting a wakeword.

Spoken voice commands, in some embodiments, are prefaced by a wakeword, which may also be referred to as a trigger expression, wake expression, or activation word. In response to detecting the wakeword, a voice activated electronic device may be configured to detect and interpret any words that subsequently follow the detected wakeword as actionable inputs or commands. In some embodiments, however, the voice activated electronic device may be activated by a phrase or grouping of words, which the voice activated electronic device may also be configured to detect, and therefore the voice activated electronic device may also be able to detect and interpret any words subsequently following that phrase.

As used herein, the term "wakeword" may correspond to a "keyword" or "key phrase," an "activation word" or "activation words," or a "trigger," "trigger word," or "trigger expression." One exemplary wakeword may be a name, such as the name, "Alexa," however persons of ordinary skill in the art will recognize that the any word (e.g., "Amazon"), or series of words (e.g., "Wake Up" or "Hello, Alexa") may alternatively be used as the wakeword. Furthermore, the wakeword may be set or programmed by an individual operating a voice activated electronic device, and in some embodiments more than one wakeword (e.g., two or more different wakewords) may be available to activate a voice activated electronic device. In yet another embodiment, the trigger that is used to activate a voice activated electronic device may be any series of temporally related sounds.

In some embodiments, the trigger may be a non-verbal sound. For example, the sound of a door opening, an alarm going off, glass breaking, a telephone ringing, or any other sound may alternatively be used to activate a sound controlled electronic device. In this particular scenario, detection of a non-verbal sound may occur in a substantially similar manner as that of a verbal wakeword for a voice activated electronic device. For example, the sound of a door opening, when detected, may activate a sound activate electronic device, which in turn may activate a burglar alarm.

A voice activated electronic device may monitor audio input data detected within its remote environment using one or more microphones, transducers, or other audio input devices located on, or in communication with, the voice activated electronic device. The voice activated electronic device may, in some embodiments, then provide the audio data representing the detected audio input data to a backend system for processing and analyzing the audio data, and providing a response to the audio data for the voice activated electronic device. Additionally, the voice activated electronic device may store one or more wakewords within its local memory. If a positive match is found between a particular word from the phrase and the wakeword, the voice activated electronic device may identify that word as the wakeword.

Electronic device 100, in some embodiments, may correspond to any suitable type of electronic device including, but are not limited to, desktop computers, mobile computers (e.g., laptops, ultrabooks), mobile phones, smart phones, tablets, televisions, set top boxes, smart televisions, watches, bracelets, display screens, personal digital assistants ("PDAs"), smart furniture, smart household devices, smart vehicles, smart transportation devices, and/or smart accessories. In some embodiments, electronic device 100 may be relatively simple or basic in structure such that no mechanical input option(s) (e.g., keyboard, mouse, track pad) or touch input(s) (e.g., touchscreen, buttons) may be provided. For example, electronic device 100 may be able to receive and output audio, and may include power, processing capabilities, storage/memory capabilities, and communication capabilities.

Electronic device 100 may include a minimal number of input mechanisms, such as a power on/off switch, however primary functionality, in one embodiment, of electronic device 100 may solely be through audio input and audio output. For example, electronic device 100 may be a voice activated electronic device, and may listen for a wakeword by continually monitoring local audio. In response to the wakeword being detected, the voice activated electronic device may establish a connection with a backend system, may send audio data to the backend system, and await/receive a response from the backend system. In some embodiments, however, electronic devices 100 may correspond to a push-to-talk device, or a low-powered electronic device (e.g., battery operated devices).

Electronic device 100 may include one or more processors 102, storage/memory 104, communications circuitry 106, one or more microphones 108 or other audio input devices (e.g., transducers), one or more speakers 110 or other audio output devices, as well as an optional input/output ("I/O") interface 112. However, one or more additional components may be included within electronic device 100, and/or one or more components may be omitted. For example, electronic device 100 may include a power supply or a bus connector. As another example, electronic device 100 may not include an I/O interface (e.g., I/O interface 112). Furthermore, while multiple instances of one or more components may be included within electronic device 100, for simplicity only one of each component has been shown.

Processor(s) 102 may include any suitable processing circuitry capable of controlling operations and functionality of electronic device 100, as well as facilitating communications between various components within electronic device 100. In some embodiments, processor(s) 102 may include a central processing unit ("CPU"), a graphic processing unit ("GPU"), one or more microprocessors, a digital signal processor, or any other type of processor, or any combination thereof. In some embodiments, the functionality of processor(s) 102 may be performed by one or more hardware logic components including, but not limited to, field-programmable gate arrays ("FPGA"), application specific integrated circuits ("ASICs"), application-specific standard products ("ASSPs"), system-on-chip systems ("SOCs"), and/or complex programmable logic devices ("CPLDs"). Furthermore, each of processor(s) 102 may include its own local memory, which may store program modules, program data, and/or one or more operating systems. However, processor(s) 102 may run an operating system ("OS") for electronic device 100, and/or one or more firmware applications, media applications, and/or applications resident thereon.

Storage/memory 104 may include one or more types of storage mediums such as any volatile or non-volatile memory, or any removable or non-removable memory implemented in any suitable manner to store data on electronic device 100. For example, information may be stored using computer-readable instructions, data structures, and/or program modules. Various types of storage/memory may include, but are not limited to, hard drives, solid state drives, flash memory, permanent memory (e.g., ROM), electronically erasable programmable read-only memory ("EEPROM"), CD-ROM, digital versatile disk ("DVD") or other optical storage medium, magnetic cassettes, magnetic tape, magnetic disk storage or other magnetic storage devices, RAID storage systems, or any other storage type, or any combination thereof. Furthermore, storage/memory 104 may be implemented as computer-readable storage media ("CRSM"), which may be any available physical media accessible by processor(s) 102 to execute one or more instructions stored within storage/memory 104. In some embodiments, one or more applications (e.g., gaming, music, video, calendars, lists, etc.) may be run by processor(s) 102, and may be stored in memory 104.

In some embodiments, storage/memory 104 may include one or more modules and/or databases, such as a speech recognition module, a wakeword database, a sound profile database, and a wakeword detection module. Furthermore, as described in greater detail below, one or more monophonic multi-band dynamics processor systems or stereo monophonic multi-band dynamics processor systems may be included within storage/memory 104. In some embodiments, electronic device 100 may include one or more components or modules of such a mono/stereo multi-band dynamics processor system. Furthermore, one or more electronic devices 100 may be employed to generate some or all of a multi-channel (e.g., 5.1 channel, 7.1 channel) audio system including such mono/stereo multi-band dynamics processor systems.

The speech recognition module may, for example, include an automatic speech recognition ("ASR") component that recognizes human speech in detected audio. The speech recognition module may also include a natural language understanding ("NLU") component that determines user intent based on the detected audio. Also included within the speech recognition module may be a text-to-speech ("TTS") component capable of converting text to speech to be outputted by speaker(s) 110, and/or a speech-to-text ("STT") component capable of converting received audio signals into text to be sent to a backend system for processing.

The wakeword database may be a database stored locally on electronic device 100 that includes a list of a current wakeword for electronic device 100, as well as one or more previously used, or alternative, wakewords for electronic device 100. In some embodiments, an individual may set or program a wakeword for their electronic device 100. The wakeword may be programmed directly on electronic device 100, or a wakeword or words may be set by the individual via a backend system application that is in communication with a backend system. For example, an individual may use their mobile device having the backend system application running thereon to set the wakeword.

In some embodiments, sound profiles for different words, phrases, commands, or audio compositions are also capable of being stored within storage/memory 104, such as within a sound profile database. For example, a sound profile of a video or of audio may be stored within the sound profile database of storage/memory 104. A sound profile, for example, may correspond to a frequency and temporal decomposition of a particular audio file or audio portion of any media file, such as an audio fingerprint or spectral representation.

The wakeword detection module may include an expression detector that analyzes an audio signal produced by microphone(s) 108 to detect a wakeword, which generally may be a predefined word, phrase, or any other sound, or any series of temporally related sounds. Such an expression detector may be implemented using keyword spotting technology, as an example. A keyword spotter is a functional component or algorithm that evaluates an audio signal to detect the presence of a predefined word or expression within the audio signal detected by microphone(s) 108. Rather than producing a transcription of words of the speech, a keyword spotter generates a true/false output (e.g., a logical I/O) to indicate whether or not the predefined word or expression was represented in the audio signal. In some embodiments, an expression detector may be configured to analyze the audio signal to produce a score indicating a likelihood that the wakeword is represented within the audio signal detected by microphone(s) 108. The expression detector may then compare that score to a wakeword threshold to determine whether the wakeword will be declared as having been spoken.

In some embodiments, a keyword spotter may use simplified ASR techniques. For example, an expression detector may use a Hidden Markov Model ("HMM") recognizer that performs acoustic modeling of the audio signal and compares the HMM model of the audio signal to one or more reference HMM models that have been created by training for specific trigger expressions. An MINI model represents a word as a series of states. Generally, a portion of an audio signal is analyzed by comparing its MINI model to an HMM model of the trigger expression, yielding a feature score that represents the similarity of the audio signal model to the trigger expression model.

In practice, an HMM recognizer may produce multiple feature scores, corresponding to different features of the HMM models. An expression detector may use a support vector machine ("SVM") classifier that receives the one or more feature scores produced by the HMM recognizer. The SVM classifier produces a confidence score indicating the likelihood that an audio signal contains the trigger expression. The confidence score is compared to a confidence threshold to make a final decision regarding whether a particular portion of the audio signal represents an utterance of the trigger expression (e.g., wakeword). Upon declaring that the audio signal represents an utterance of the trigger expression, electronic device 100 may then begin transmitting the audio signal to a corresponding backend system for detecting and responding to subsequent utterances made by an individual or by an additional electronic device.

Communications circuitry 106 may include any circuitry allowing or enabling electronic device 100 to communicate with one or more devices, servers, and/or systems. For example, communications circuitry 106 may facilitate communications between electronic device 100 and an associated backend system. As another example, communications circuitry 106 may facilitate communications between electronic device 100 and one or more additional instances of electronic device 100, or one or more additional audio output components. Communications circuitry 106 may use any communications protocol, such as, for example, Transfer Control Protocol and Internet Protocol ("TCP/IP") (e.g., any of the protocols used in each of the TCP/IP layers), Hypertext Transfer Protocol ("HTTP"), and wireless application protocol ("WAP"), are some of the various types of protocols that may be used to facilitate communications between electronic device 100 and a backend system, or between electronic device 100 and any additional electronic device. In some embodiments, electronic device 100 and a backend system or other electronic device may communicate with one another via a web browser using HTTP. Various additional communication protocols may be used to facilitate communications for electronic device 100 include, but are not limited to, Wi-Fi (e.g., 802.11 protocol), Bluetooth®, radio frequency systems (e.g., 900 MHz, 1.4 GHz, and 5.6 GHz communication systems), cellular networks (e.g., GSM, AMPS, GPRS, CDMA, EV-DO, EDGE, 3GSM, DECT, IS-136/TDMA, iDen, LTE or any other suitable cellular network protocol), infrared, BitTorrent, FTP, RTP, RTSP, SSH, and/or VOIP.

In some embodiments, electronic device 100 may also include an antenna to facilitate wireless communications with a network using various wireless technologies (e.g., Wi-Fi, Bluetooth®, radiofrequency, etc.). In yet another embodiment, electronic device 100 may include one or more universal serial bus ("USB") ports, one or more Ethernet or broadband ports, and/or any other type of hardwire access port so that communications circuitry 106 allows electronic device 100 to communicate with one or more communications networks.

Electronic device 100 may also include one or more microphones 108 and/or transducers. Microphone(s) 108 may be any suitable component capable of detecting audio signals. For example, microphone(s) 108 may include one or more sensors for generating electrical signals and circuitry capable of processing the generated electrical signals. In some embodiments, microphone(s) 108 may include multiple microphones capable of detecting various frequency levels. As an illustrative example, electronic device 100 may include multiple microphones (e.g., four, seven, ten, etc.) placed at various positions about electronic device 100 to monitor/capture any audio outputted in the environment where electronic device 100 is located. The various microphones 108 may include some microphones optimized for distant sounds, while some microphones may be optimized for sounds occurring within a close range of electronic device 100.

Electronic device 100 may further include one or more speakers 110. Speaker(s) 110 may correspond to any suitable mechanism for outputting audio signals. For example, speaker(s) 110 may include one or more speaker units, transducers, arrays of speakers, and/or arrays of transducers that may be capable of broadcasting audio signals and or audio content to a surrounding area where electronic device 100 may be located. In some embodiments, speaker(s) 110 may include headphones or ear buds, which may be wirelessly wired, or hard-wired, to electronic device 100, that may be capable of broadcasting audio directly to an individual. In some embodiments, speakers 110 may correspond to various portions of an audio system, such as a stereo, 5.1 channel, or 7.1 channel audio system. As such, speakers 110 may include, or be in communication with, one or more additional speakers 110 external to electronic device 100. For example, electronic device 100 may be employed within a 5.1 channel audio system (e.g., serving as one or more speaker units or controlling the various speaker units included therein).

In one exemplary embodiment, electronic device 100 includes I/O interface 112. The input portion of I/O interface 112 may correspond to any suitable mechanism for receiving inputs from a user of electronic device 100. For example, a camera, keyboard, mouse, joystick, button, toggle switch, dial, or external controller may be used as an input mechanism for I/O interface 112. In some embodiments, the input portion of I/O interface 112 may correspond to a remote control that may function to control one or more functions of electronic device 100. The output portion of I/O interface 112 may correspond to any suitable mechanism for generating outputs from electronic device 100. For example, one or more displays may be used as an output mechanism for I/O interface 112. As another example, one or more lights, light emitting diodes ("LEDs"), or other visual indicator(s) may be used to output signals via I/O interface 112 of electronic device 100. In some embodiments, one or more vibrating mechanisms or other haptic features may be included with I/O interface 112 to provide a haptic response to an individual from electronic device 100. Persons of ordinary skill in the art will recognize that, in some embodiments, one or more features of I/O interface 112 may be included in a purely voice activated version of electronic device 100. For example, one or more LED lights may be included on electronic device 100 such that, when microphone(s) 108 receive audio, the one or more LED lights become illuminated signifying that audio has been received by electronic device 100. In some embodiments, I/O interface 112 may include a display screen and/or touch screen, which may be any size and/or shape and may be located at any portion of electronic device 100. Various types of displays may include, but are not limited to, liquid crystal displays ("LCD"), monochrome displays, color graphics adapter ("CGA") displays, enhanced graphics adapter ("EGA") displays, variable graphics array ("VGA") display, or any other type of display, or any combination thereof. Still further, a touch screen may, in some embodiments, correspond to a display screen including capacitive sensing panels capable of recognizing touch inputs thereon.

Audio input signal 2, in some embodiments, corresponds to a wideband audio signal representing audio at multiple frequencies. Audio input signal 2 may, for example, correspond to music, voice, speech, audio from video, or any other multi-frequency signal, or any combination thereof. Upon receipt of audio input signal 2, electronic device 100 may apply one or more filters and/or gains, and may provide audio input signal 2 to speaker(s) 108 to be output. Audio output signal 4 of FIG. 1A, however, may include unwanted compression of one or more frequency bands. In particular, the compressed frequency band(s) may not be the same as the frequency bands of audio input signal 2. This, as mentioned above, is an effect of intermodulation distortion ("IM").

In some embodiments, electronic device 100 may include various functional modules and components to reduce the effects of IM to audio input signal 4. For example, in some embodiments, a multi-band dynamics processing ("MBDP") system may be used by electronic device 100 to reduce IM effects. The MBDP system may be a monophonic and/or stereophonic MBDP system, for example. By using the MBDP processing system, electronic device 100 may output audio output signal 6 of FIG. 1B based on audio input signal 2, where audio output signal 6 does not include compression of any frequency bands due to IM. For instance, comparison of audio output signal 4 of FIG. 1A and audio output signal 6 of FIG. 1B may visually describe how an MBDP system, as described herein, may remove unwanted compression of various frequency bands, thereby generating an audio output signal that removes overshoots distortions, and, generally, has a greater sound quality.

Figure 2:
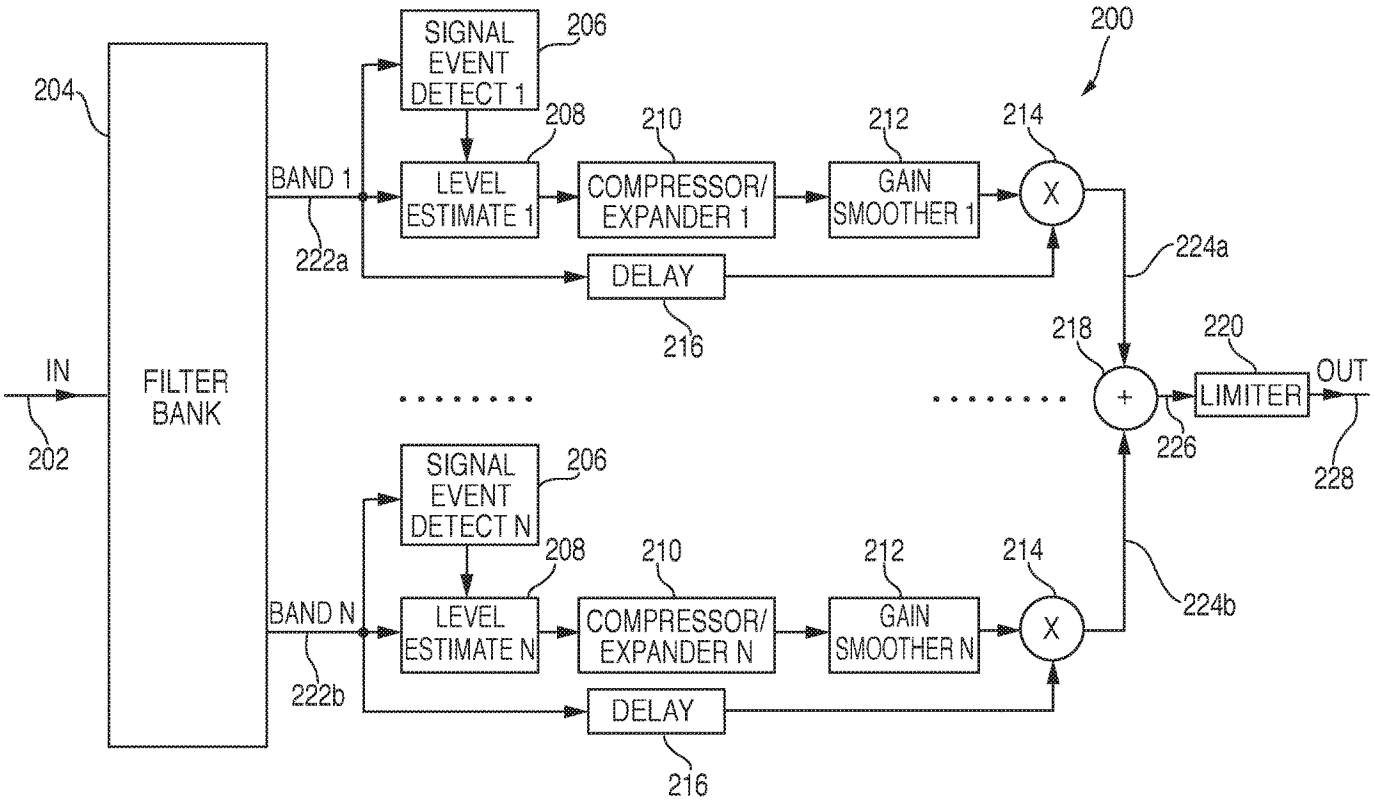
FIG. 2 is an illustrative schematic of a monophonic multi-band dynamics processor system, in accordance with various embodiments.

FIG. 2 is an illustrative schematic of a monophonic multi-band dynamics processor system. Monophonic, or "mono," multi-band dynamics processor ("MBDP") system 200, in the illustrative embodiment, functions to reduce the effects of IM in a monophonic audio system. A monophonic audio system is one where output audio is generated such that the sound appears as if it where originating from a single position. This differs from a stereophonic sound system, which is described in greater detail below with reference to FIG. 3, where the output audio creates the perception of being multi-directional.

Mono MBDP system 200, in some embodiments, may be included within electronic device 100. For example, mono MBDP system 200 may be stored within storage/memory 104. An audio input signal 202 may be received by mono MBDP system 200 of electronic device 100, and audio input signal 202 may correspond to a wideband audio input signal. For example, audio input signal 202 may include audio at multiple frequencies.

Audio input signal 202, which may be received by electronic device 100, may initially be provided to filter bank 204. For example, audio input signal 202 may correspond to received audio data representing speech. Filter bank 204 may be configured to split audio input signal 202 into one or more filtered audio signals of various frequency bands. For example, filter bank 204 may be configured to split audio input signal 202 into N filtered audio signals corresponding to N-frequency bands, where N is an integer having values of 2, 3, 4, or 5. However, persons of ordinary skill in the art will recognize that this is merely exemplary, and the value of N may be any suitable integer value. Filter bank 204, furthermore, is described in greater detail below with reference to FIG. 7.

In some embodiments, filter bank 204 may generate filtered audio signals 222*a* and 222*b* in response to audio input signal 202 being applied to filter bank 204. Filtered audio signal 222*a* may correspond to a first frequency band, such as band 1. Filtered audio signal 222*b* may correspond to a second frequency band, such as band N. The number of filtered audio signals may depend on the construction of filter bank 204, and although system 200 includes only two filtered audio signals 222*a* and 222*b*, persons of ordinary skill in the art will recognize that any number of filtered audio signals may be generated. For example, filter bank 204 may be configured to split audio input signal 202 into five frequency bands, and therefore filtered audio signal 222*a* would correspond to a filtered audio signal of the first frequency band, and filtered audio signal 222*b* would correspond to a filtered audio signal of the fifth frequency band. In this particular example, three additional filtered audio signals would also be produced by filter bank 204: one corresponding to the second frequency band, the third frequency band, and the fourth frequency band. Thus, N filtered audio signals, corresponding to N frequency bands, will be generated by filter bank 204.

In some embodiments, the filtered audio signals, such as filtered audio signal 222*a* or 222*b*, may be delayed by a delay time D using delay module 216. Delay module 216 may delay the filtered audio signals such that any latency due to determining an amount of adaptive gain to apply to the filtered audio signal. For example, delay time D may be only a few samples in duration, corresponding to a few milliseconds, however any suitable delay time may be used.

The filtered audio signals 222*a* and 222*b*, in addition to being delayed by delay module 216, may be provided to signal event detector module 206. In some embodiments, a copy of filtered audio signals 222*a* and 222*b* may be provided to signal event detector module 206, while original filtered audio signals 222*a* and 222*b* is provided to their respective delay modules 216, however this is merely exemplary. Furthermore, for each of filtered audio signals 222*a* and 222*b*, there may be a respective signal event detector module 206. For example, if filter bank 204 splits audio input signal 202 into three filtered audio signals of three frequency bands, then there may be three instances of signal event detector module 206 for each of the three filtered audio signals.

Signal event detector module 206, in some embodiments, may determine a type of signal that is included within its respective filtered audio signal that is provided thereto. For example, each of filtered audio signals 222*a* and 222*b* may include one or more instances of audio events, such as speech or voice, or non-audio events, such as silence or noise. Signal event detector module(s) 206 may, therefore, analyze each filtered audio signal to determine whether that particular filtered audio signal of a particular frequency band includes an audio event or a non-audio event.

Figure 3:
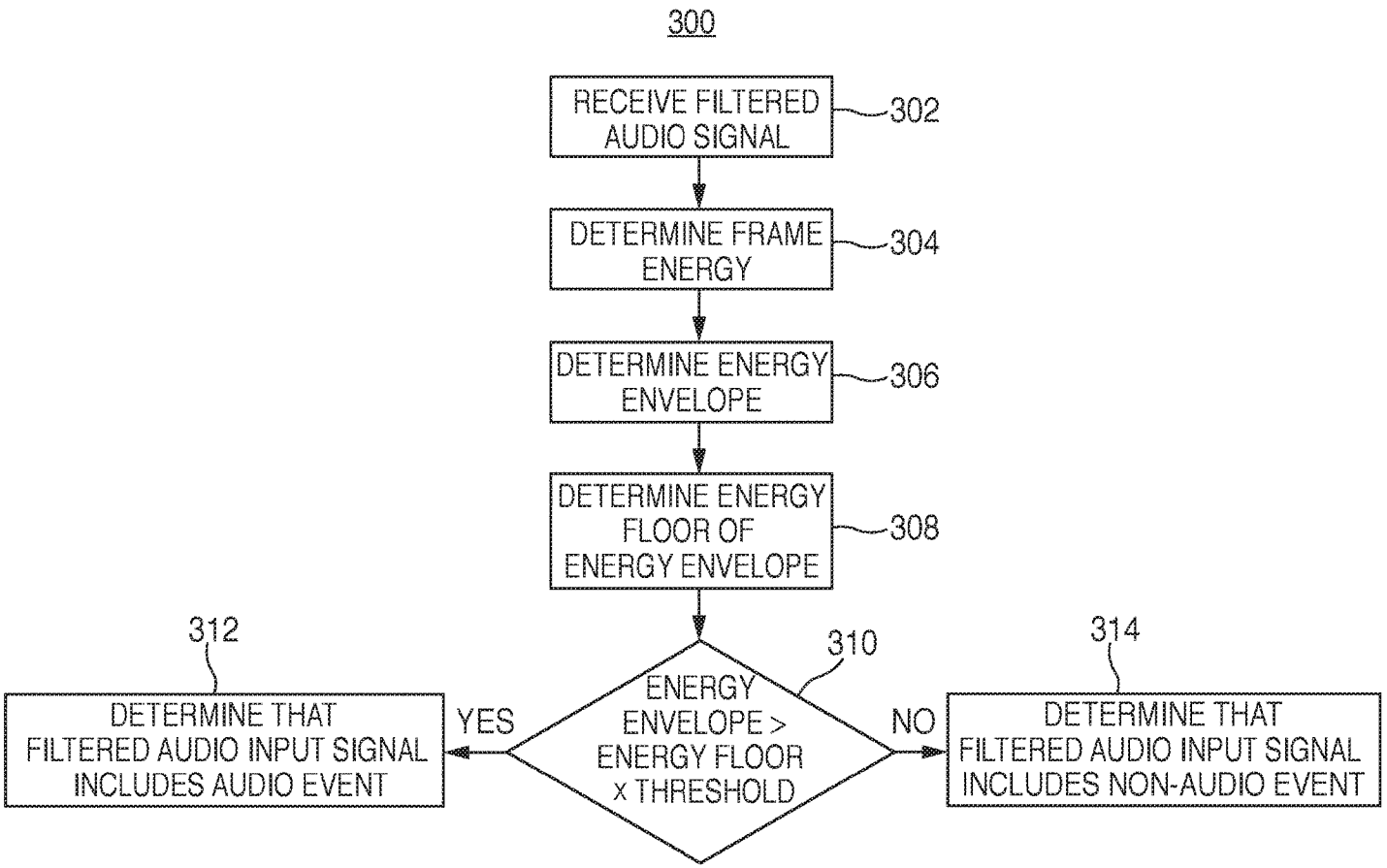
FIG. 3 is an illustrative flowchart of a process for determining whether an audio frame includes an audio event or a non-audio event, in accordance with various embodiments.

FIG. 3 is an illustrative flowchart of a process for determining whether an audio frame includes an audio event or a non-audio event, in accordance with various embodiments. In some embodiments, signal event detector module 206 may perform process 300 for a corresponding filtered audio signal 222*a*, 222*b*. Process 300 may, in some embodiments, begin at step 302. At step 302, the filtered audio signal (e.g., filtered audio signals 222*a* and 222*b*) may be received by signal event detector module 206. Each of the N filtered audio signals may be provided to their own signal event detector module 206. In other words, there may be N instances of signal event detector module 206 corresponding to each of the N filtered audio signals produced by filter bank 204. Although only one signal event detector module 206 is described, persons of ordinary skill in the art will recognize that multiple instances of signal event detector module 206 may be similarly configured.

In some embodiments, signal event detector module 206 may segment filtered audio signal 222*a* into multiple audio frames of frame length L. Frame length L, which may be in units of samples, may be determined based on a sampling rate of audio input signal 202. For example, frame length L may be 96 samples in length for 2 milliseconds of filtered audio signal 222*a* at a sampling rate of 48 kHz. A similar process may be performed by signal event detector 206 for filtered audio signal 222*b* (or any other filtered audio signal), such that filtered audio signal 222*b* is also segmented into multiple audio frames having the same frame length L. In particular, for mono MBDP system 200, frame length L should be constant across the N filtered audio signals of N frequency bands.

At step 304, a frame energy of each audio frame of a filtered audio signal may be determined. In some embodiments, an energy level value representing an energy level of each audio frame's energy may be determined. Signal event detector module 206 may determine a frame energy of a corresponding audio frame using Equation 1:

$$E(k,n)=\frac{1}{L}\sum_{i=0}^{L-1}|x(k,i)|,\text{ or } E(k,n)=\frac{1}{L}\sum_{i=0}^{L-1}(x(k,i))^2. \quad \text{Equation 1}$$

In Equation 1, x(k,i) corresponds to the i-th audio sample in the n-th audio frame of a filtered audio signal of frequency band k, where k=1, 2, . . . , N. For example, filtered audio signal 222*a* may correspond to frequency band 1. In this scenario, k=1 and a block of filtered audio signal 222*a* in this frequency band (e.g., k=1) would be x(1,0), x(1,1), . . . , x(1,L−1). As another example, filtered audio signal 222*b* may correspond to frequency band N. In this scenario, k=N, and a block of filtered audio signal 222*b* in this frequency band would be x(N, 0), x(N,1), . . . , x(N,L−1).

At step 306, an energy envelope of a corresponding audio frame for a particular frequency band may be determined. In some embodiments, the determination of energy envelope V(k,n) may be implemented using Equation 2:

$$V(k,n)=V(k,n-1)+\text{EnvelopeFactor_}k\times(E(k,n)-V(k,n-1)) \quad \text{Equation 2.}$$

In Equation 2, frame energy E(k,n) may be determined using Equation 1, and EnvelopeFactor_k may correspond to a smoothing factor having a value ranging between 0.0 and 1.0. For example, EnvelopeFactor_k may be 0.01.

At step 308, an energy floor Fl(k,n), or lower limit, of energy envelope V(k,n) may be determined for a particular frequency band. In some embodiments, the determination of energy floor Fl(k,n) may be implemented using Equation 3:

$$Fl(k,n)=Fl(k,n-1)+\text{FloorFactor_}k\times(V(k,n)-Fl(k,n-1)) \quad \text{Equation 3.}$$

In Equation 3, V(k,n) may be determined using Equation 2, and FloorFactor_k may correspond to a smoothing factor having a value ranging between 0.0 and 1.0. For example, FloorFactor_k may be 0.00041.

At step 310, a determination may be made as to whether or not energy envelope V(k,n), which may have been determined at step 306, is greater than an energy floor Fl(k,n), which may have been determined at step 308, multiplied by an energy ratio threshold value $Fl_{Threshold}$ (e.g., $V(k,n)>Fl(k,n)\times Fl_{Threshold}$). Energy ratio threshold value $Fl_{Threshold}$ may be an adjustable constant, and may be set prior to a filtered audio signal being received by its corresponding signal event detector module 206. As an illustrative example, energy ratio threshold value $Fl_{Threshold}$ may be approximately $Fl_{Threshold}=0.50$. If, at step 310, it is determined that the energy envelope V(k,n) for a particular audio frame of a particular frequency band k is greater than the energy floor Fl(k,n) multiplied by predefined energy ratio threshold value $Fl_{Threshold}$, then process 300 may proceed to step 312. At step 312, it may be determined that the audio frame of the corresponding filtered audio signal (e.g., filtered audio signal 222*a*, 222*b*) that was analyzed at step 310 includes an audio event (e.g., speech, sound, voice). If, however, at step 310, it is determined that the energy envelope V(k,n) for the particular audio frame of the particular frequency band k is less than or equal to the energy floor Fl(k,n) multiplied by the predefined energy ratio threshold value $Fl_{Threshold}$, then process 300 may proceed to step 314. At step 314, it may be determined that the audio frame of the corresponding filtered audio signal (e.g., filtered audio signal 222*a*, 222*b*) that was analyzed at step 310 includes a non-audio event (e.g., noise or silence).

As mentioned previously, signal event detector module 206 may employ process 300 to determine whether any of the N filtered audio signals generated by filter bank 204 includes an audio event or a non-audio event. Thus, the frame length L of each audio frame across all of the various filtered audio signals of the different frequency bands should be the same. However, the values of EnvelopeFactor_k, FloorFactor_k, and energy ratio threshold value $Fl_{Threshold}$ may differ across different frequency bands. For example, frequency band k=1, EnvelopeFactor_1 may be 0.01, while for frequency band k=2, EnvelopeFactor_2 may be 0.02. For a multi-channel system (e.g., stereo, 5.1 channel, 7.1 channel, etc.), as described in greater detail below, the values of each of EnvelopeFactor_k, FloorFactor_k, and energy ratio threshold value $Fl_{Threshold}$ should be the same for similar frequency bands across different channels. For example, both a left channel and a right channel may have, for frequency band k=1, EnvelopeFactor_1 be 0.01, while both the left channel and the right channel may have, for frequency band k=2, EnvelopeFactor_2 be 0.02

Returning to FIG. 2, at a substantially same time as, or after, signal event detector module 206 determines whether or not a corresponding filtered audio signal of a particular frequency band k includes an audio event or a non-audio event, a signal level estimation may be performed by signal level estimation module 208. For example, filtered audio signal 222*a* (as well as filtered audio signal 222*b*) may be provided to both signal event detector module 206 and signal level estimation module 208, such that modules 206 and 208 may operate in parallel. Signal level estimation module 208, in some embodiments, may be used to determine a particular function of compressor/expander module 210. For example, depending on the signal level, compressor/expander module 210 may function as a compressor, an expander, or with no compression effects. Compressor/expander module 210 may then be used to determine an amount of adaptive audio gain to apply for gain smoothing by gain smoother 212. In some embodiments, the signal level estimation and determination of whether that signal level estimation corresponds to a compressor, expander, or linear case may be described by FIG. 4.

Figure 4:
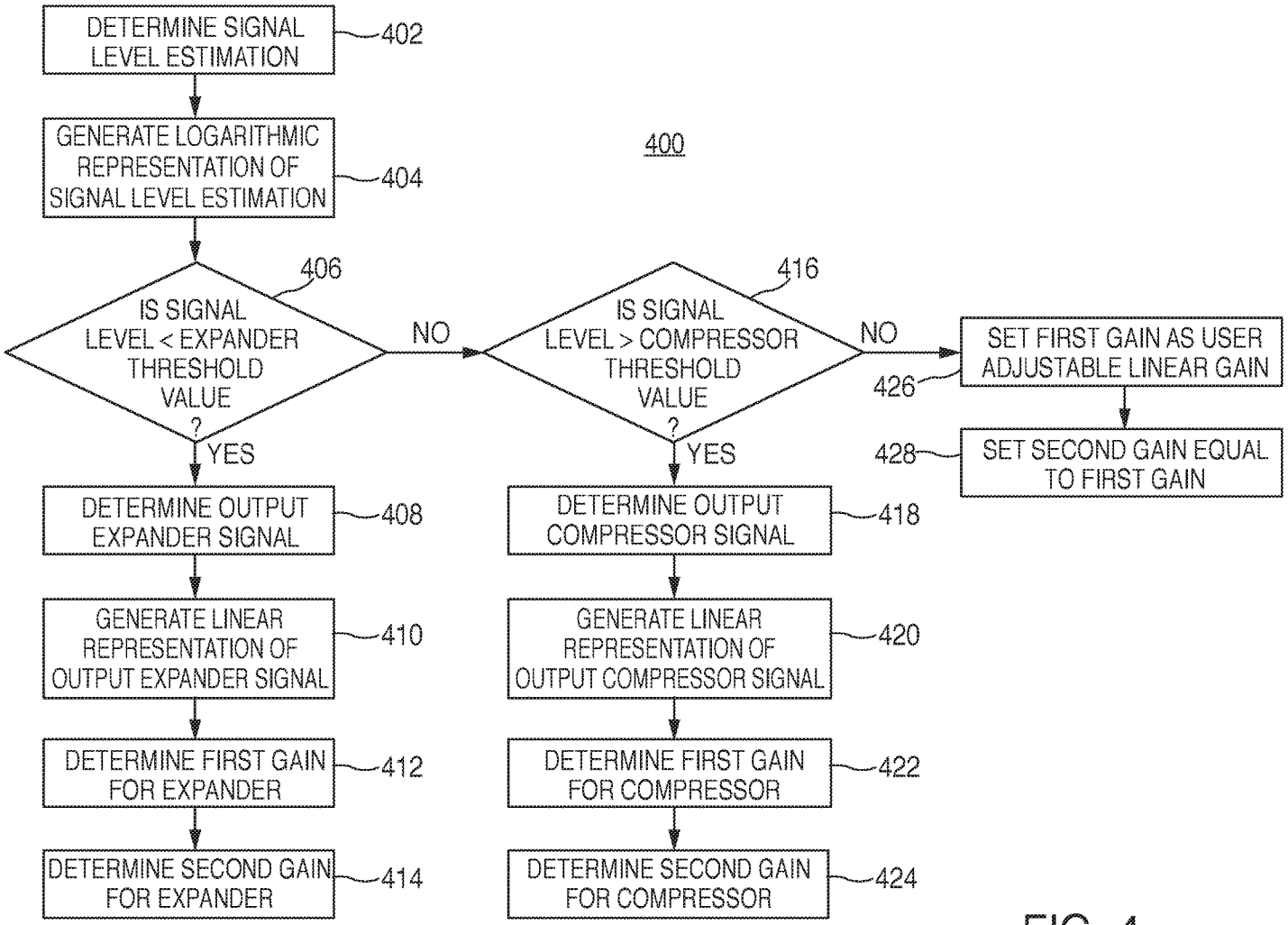
FIG. 4 is an illustrative flowchart of a process for determining an adaptive gain amount, in accordance with various embodiments.

FIG. 4 is an illustrative flowchart of a process for determining an adaptive gain amount, in accordance with various embodiments. In some embodiments, process 400 may begin at step 402, where a signal level estimation may be determined by signal level estimation module 208. The signal level estimation for each frequency band may be implemented using a fast-attack and slow-release filter, as described using Equations 4 and 6. Equation 4 may correspond to step 314 of process 300, where the filtered audio signal may be determined to include non-audio events:

$$SL(k,n)=SL(k,n-1) \quad \text{Equation 4.}$$

Equations 5 and 6, however, may correspond to step 312 of process 300, where the filtered audio signal may be determined to include audio events, such that:

$$\text{If } E(k,n)>SL(k,n-1), \beta=\text{LevelAttack_}k;$$

$$\text{Else}=\text{LevelRelease_}k \quad \text{Equation 5.}$$

In Equation 5, SL(k,n) may be defined using Equation 6:

$$SL(k,n)=SL(k,n-1)+\beta\times(E(k,n)-SL(k,n-1)) \quad \text{Equation 6.}$$

For instance, in Equation 6, an intensity value representing an intensity of the filtered audio signal for a particular frequency band k may be determined by multiplying one of LevelAttack_k or LevelRelease_k with the difference between the energy level value and a previous energy level value corresponding to a previous energy level of a previous audio frame of a filtered audio signal. Both LevelAttack_k and LevelRelease_k are related to time constants for the fast-attack and slow-release filter. Different frequency bands k may have different values for LevelAttack_k and LevelRelease_k, however each corresponding frequency band k should have the same value across different channels (e.g., for stereo, 5.1 channel, 7.1 channel systems). As an illustrative example, LevelAttack_k=0.0152778 and LevelRelease_k=0.0015278 for 3 milliseconds and 30 milliseconds, respectively, and LevelAttack_k=0.002291667 and LevelRelease_k=0.000229167 for 10 milliseconds and 100 milliseconds, respectively.

At step 404, the signal level estimation SL(k,n) that was determined at step 402 may be converted from the linear domain into the logarithmic domain. This may occur because compressor/expander module 210 operates in the decibel domain ("dB"), which is a logarithmic unit, and is shown on the x-axis and y-axis of FIG. 5. In some embodiments, a logarithmic representation of the signal level estimation may be generated at step 404. For instance, a logarithmic representation value of the intensity value may be generated. The generation of the logarithmic representation may occur using signal level estimation module 208, or alternatively using compressor/expander module 210, however persons of ordinary skill in the art will recognize that either module may be used, or an additional intermediary module may be employed to perform the logarithmic conversion.

At step 406, a determination may be made as to whether the logarithmic representation of signal level estimation SL(k,n) is less than an expander threshold value Th1. Expander threshold value Th1, in one embodiment, is a user adjustable parameter indicating a transition point on a compression static curve (e.g., see FIG. 5) of when the input signal's corresponding output signal is to be increased. For example, expander threshold value Th1 may be approximately −65 dB. Therefore, if SL(k,n)<−65 dB, then the output signal may be increased. If, at step 406, it is determined that the logarithmic representation is less than expander threshold value Th1, which may be expressed in decibels as well, then process 400 may correspond to an "expander," and may then proceed to step 408. However, if at step 406 it is determined that the logarithmic representation is greater than or equal to expander threshold value Th1, then process 400 may proceed to step 416. At step 416, a determination may be made as to whether the logarithmic representation is greater than a compressor threshold value Th2. Compressor threshold value Th2, in one embodiment, is another user adjustable parameter indicating another transition point on the compression static curve where the input signal's corresponding output signal is to be decreased. For example, compressor threshold value Th2 may be approximately −40 dB, and therefore if SL(k,n) is greater than −40 dB, then the output signal may be decreased. If, at step 416, it is determined that the logarithmic representation is greater than compressor threshold value Th2, which may also be expressed in decibels, then process 400 may correspond to a "compressor," and therefore may proceed to step 418. However, if at step 416 it is determined that the logarithmic representation is less than or equal to compressor threshold value Th2, then process 400 may proceed to step 426.

In some embodiments, compressor/expander module 210 of FIG. 2 may be implemented to achieve "hard-knee" compression effects. A sharp transition may be referred to as a hard-knee, providing a more noticeable compression effect. In some embodiments, however, compressor/expander module 210 may be implemented to achieve "soft-knee" compression effects. A "soft-knee" may refer to softer, more rounded transition where the compression effects are more subtle. A "knee width" W of the transition region of the soft-knee transition curve may be seen, for example, via FIG. 5.

Figure 5:
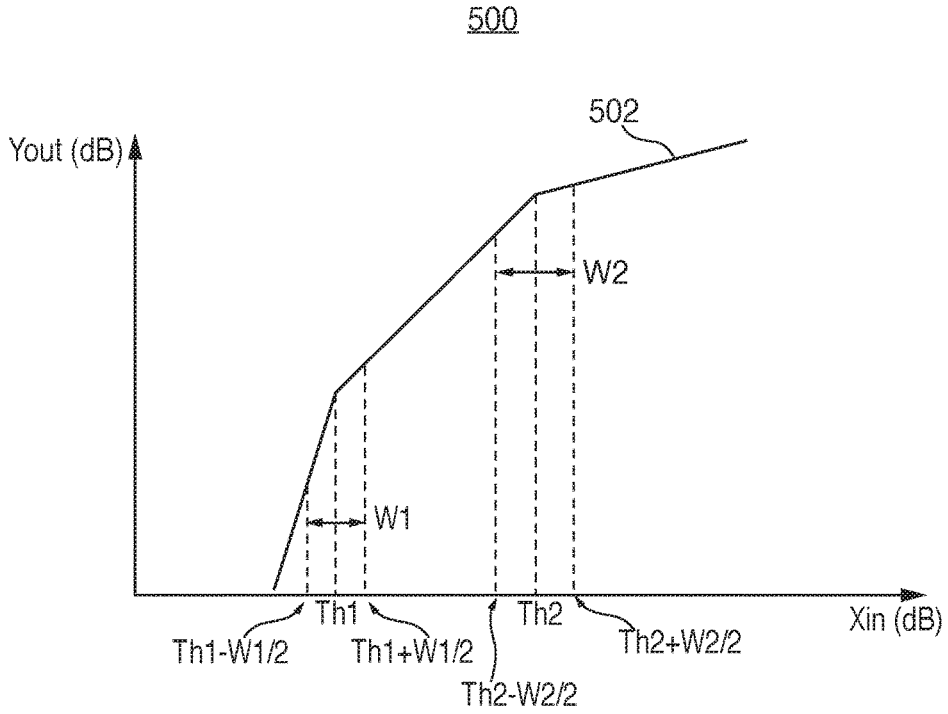
FIG. 5 is an illustrative graph of a "hard-knee" and a "soft-knee" compression static curve, in accordance with various embodiments.

FIG. 5 is an illustrative graph of a "hard-knee" and a "soft-knee" compression static curve, in accordance with various embodiments. Graph 500 includes both a transition curve 502. Depending on the logarithmic representation of signal level estimation SL(k,n), which corresponds to $x_{in}$ (dB) of FIG. 5, a corresponding output value, $y_{out}$(dB) of FIG. 5, along curve 502 may be determined. Furthermore, knee widths W1 and W2, in the exemplary embodiment, are in the logarithmic domain having base B, such as base 2, base 10, or base e (e.g., e may be referred to as Euler's number having an approximate value of 2.71828).

In some embodiments, user adjustable compression ratios R1 and R2 may be set by an individual operating electronic device 100. However, user adjustable compression ratios R1 and R2 may alternatively be programmed during manufacturing of electronic device 100, and may be modified by an individual operating electronic device 100 at a later point in time. The compressor case may correspond to compression ratio R2 being greater than one (e.g., R2>1.0), whereas the expander case may correspond to compression ratio R1 being less than one but greater than zero (e.g., 0.0<R1<1.0).

In some embodiments, expander threshold value Th1 and compressor threshold value Th2, may also be set by an individual operating electronic device 100, or expander threshold value Th1 and compressor threshold value Th2 may be set during manufacture of electronic device 100, and may be adjusted by an individual operating electronic device 100 at a later point in time. As mentioned previously, both expander threshold value Th1 and compressor threshold value Th2 may be in the logarithmic domain with base B, as they both may be in units of decibels. Furthermore, in the exemplary embodiment, expander threshold value Th1 and compressor threshold value Th2 may be set such that expander threshold value Th1 is less than compressor threshold value Th2 (e.g., Th1<Th2).

The expander case may include three user adjustable parameters: knee-width W1, compression ratio R1, and expander threshold value Th1. The compressor case may also include three user adjustable parameters: knee-width W2, compression ratio R2, and compressor threshold value Th2. Expander knee-width W1 and compressor knee width W2 may both be positive, logarithmic values having base B (e.g., base 2, base 10, or base e, where e correspond to Euler's number). Expander knee-width W1 may range about expander threshold value Th1 (e.g., Th1−W1/2 to Th1+W1/2), while compressor knee-width W2 may range about compressor threshold value Th2 (e.g., Th2−W2/2 to Th2+W2/2). Furthermore, in the illustrative embodiment, expander knee-width W1 and compressor knee-width W2 follow Equation 7:

$$Th1 + W_1/2 < Th2 - W_2/2. \quad \text{Equation 7}$$

Returning to FIG. 4, at step 408 an output expander signal may be determined. For the expander case, there may be two separate processing intervals: a normal expander, and an expander in softer transition with knee-width W1. For a normal expander, the logarithmic representation of signal level estimation SL(k,n) is less than or equal to the difference between expander threshold value Th1 and half of expander knee-width $$W1(\text{e.g., } \log(SL(k,n)) \le Th1 - W_1/2).$$

For this condition, the output expander signal may be expressed as $$Y = (1/R1 - 1) \times [Th1 - W_1/2 - \log(SL(k,n))],$$

where Y is the output expander signal in the logarithmic domain. Furthermore, in the exemplary embodiment, the output expander signal is greater than zero (e.g., Y>0.0) as expander compression ratio R1 is greater than zero but less than one (e.g., 0.0<R1<1.0).

For an expander in softer transition with knee-width W1, the logarithmic representation of signal level estimation SL(k,n) is greater than the difference between expander threshold value Th1 and half of expander knee-width W1, as well as being less than the aggregate of expander threshold value Th1 and half of expander knee-width $$W1(\text{e.g., } Th1 - W_1/2 < \log(SL(k,n)) < Th1 + W_1/2).$$

For this condition, the output expander signal may be expressed as $$Y = (1/R1 - 1) \times (\log(SL(k,n)) - Th1 + W_1/2)^2/(2W1),$$

where Y, again, is the output expander signal in the logarithmic domain. Furthermore, in the exemplary embodiment, the output expander signal is also greater than zero (e.g., Y>0.0) due to expander compression ratio R1 being greater than zero but less than one (e.g., 0.0<R1<1.0).

At step 410, a linear representation of output expander signal Y may be generated. This may occur by converting output expander signal Y from the logarithmic domain into the linear domain. Persons of ordinary skill in the art will recognize that any suitable conversion technique may be used to generate the linear representation of the output expander signal.

At step 412, a first gain for the expander case may be determined. A first gain, Gain1, may correspond to base B raised to output expander signal Y (e.g., Gain1=B^Y). In this particular scenario, first gain Gain1 is greater than one (e.g., 1.0) for the case of output expander signal Y being greater than zero (e.g., Gain1>1.0 for Y>0.0). In one embodiment, first gain Gain1 may be determined using output expander value Y for the normal expander case, or for the softer transition with knee-width W1 expander case.

At step 414, a second gain for the expander case may be determined. A second gain, Gain2, may be expressed as first gain Gain1 multiplied by a user adjustable gain, G (e.g., Gain2=Gain1×G). User adjustable gain G may, in some embodiments, be any value greater than zero (e.g., 0.0), and may be set, or modified, by an individual operating electronic device 100. User adjustable gain G may, in some embodiments, function to balance the processed audio signals with any of the other processed audio signals.

If, however, the logarithmic representation of signal level estimation SL(k,n) is determined to be greater than compressor threshold value Th2 at step 416, then process 400 may proceed to step 418, corresponding to the compressor case. At step 418, an output compressor signal may be determined. For the compressor case, there may be two separate processing intervals: a compressor in softer transition with knee-width W2, and a normal compressor. For a compressor in softer transition with knee-width W2, the logarithmic representation of the signal level estimation may be greater than the difference between compressor threshold value Th2 and half of knee-width W2, while also being less than the aggregate of compressor threshold value Th2 and half of knee-width $$W2(\text{e.g., } Th2 - W_2/2 < \log(SL(k,n)) < Th2 + W_2/2).$$

For this condition, the output compressor signal may be expressed as $$Y = (1/R2 - 1) \times (\log(SL(k,n)) - Th2 + W_2/2)^2/(2W2),$$

where Y is the output compressor signal in the logarithmic domain. Furthermore, in the exemplary embodiment, the output expander signal Y may be less than zero (e.g., Y<0.0) as compression ratio R2 may be greater than 1.0 (e.g., R2>1.0).

For a normal compressor, the logarithmic representation of the signal level estimation may be greater than or equal to the aggregate of compressor threshold value Th2 and half of knee-width $$W2(\text{e.g., } \log(SL(k,n)) \ge Th2 + W_2/2).$$

For this condition, the output compressor signal may be expressed as $$Y = (1 - 1/R2) \times [Th2 + W_2/2 - \log(SL(k,n))],$$

where Y, again, is the output compressor signal in the logarithmic domain. Furthermore, in the exemplary embodiment, the output expander signal may be less than zero (e.g., Y<0.0) due to compression ratio R2 being greater than one (e.g., R2>1.0).

At step 420, a linear representation of output expander signal Y may be generated. This may occur by converting the output expander signal Y from the logarithmic domain into the linear domain. Persons of ordinary skill in the art will recognize that any suitable conversion technique may be used to generate the linear representation of the output expander signal.

At step 422, a first gain for the compressor case may be determined. A first gain, Gain1, may correspond to base B raised to output expander signal Y (e.g., Gain1=B^Y). In this particular scenario, first gain Gain1 may be greater than zero but less than one for output expander signal Y being less than zero (e.g., 0.0<Gain1<1.0 for Y<0.0). In one embodiment, first gain Gain1 may be determined using output compressor signal Y for the compressor in softer transition with knee-width W2, as well as for the normal compressor case.

At step 424, a second gain for the compressor case may be determined. The second gain, Gain2, may corresponding to first gain Gain1 multiplied by user adjustable gain G (e.g., Gain2=Gain1×G). User adjustable gain G, as described in greater detail above, be any value larger than zero (e.g., G>0.0).

In some embodiments, the logarithmic representation of the signal level estimation may be greater than or equal to expander threshold value Th1, while also being less than or equal to compressor threshold value Th2. If, at step 416, it is determined that the logarithmic representation of the signal level estimation is not greater than compressor threshold value Th2, then process 400 may proceed to step 426. This particular scenario may correspond to there being no compression effects at all for the output signal.

At step 426, first gain Gain1 may be set as being equal to user adjustable gain G (e.g., Gain1=G). Furthermore, at step 428, second gain Gain2 may be set as being equal to first gain Gain1 (e.g., Gain2=Gain1). Table 1 provides an overview of the different gains that may be applicable for the five different cases mentioned above (e.g., normal expander, expander in softer transition with knee-width W1, normal compressor, compressor in softer transition with knee-width W2, and no compression).

In some embodiments, the various frequency bands k (e.g., N frequency bands) corresponding to filtered audio signals 222*a* and 222*b* may each have a different value for compression ratios R1 and R2, expander threshold value Th1, compressor threshold value Th2, knee-widths W1 and W2, as well as user adjustable gain G. However, base B should be constant across each frequency band k. Furthermore, for a soft-knee transition, Equation 7 should be obeyed, where knee-widths W1 and W2 are both greater than zero (e.g., W1>0.0, W2>0.0).

TABLE 1

| Case | Signal Level Condition | Output Signal | First Gain | Second Gain |
|---|---|---|---|---|
| Normal Expander | $\log(SL(k, n)) \leq Th1 - W_1/2$ | $Y = (1/R1 - 1) \times [Th1 - W_1/2 - \log(SL(k, n))]$ | $Gain1 = B^Y$ | $Gain2 = Gain1 \times G$ |
| Expander In Soft Transition With Knee-Width W1 | $Th1 - W_1/2 < \log(SL(k, n)) < Th1 + W_1/2$ | $Y = (1/R1 - 1) \times (\log(SL(k, n)) - Th1 + W_1/2)^2/(2W1)$ | $Gain1 = B^Y$ | $Gain2 = Gain1 \times G$ |
| No Compression | $Th1 + W_1/2 \leq \log(SL(k, n)) \leq Th2 + W_2/2$ | N/A | $Gain1 = G$ | $Gain2 = Gain1$ |
| Compressor In Soft Transition With Knee-Width W2 | | $Y = (1/R2 - 1) \times (\log(SL(k, n)) - Th2 + W_2/2)^2/(2W2)$ | $Gain1 = B^Y$ | $Gain2 = Gain1 \times G$ |
| Normal Compressor | $\log(SL(k, n)) \geq Th2 + W_2/2$ | $Y = (1 - 1/R2) \times [Th2 + W_2/2 - \log(SL(k, n))]$ | $Gain1 = B^Y$ | $Gain2 = Gain1 \times G$ |

Returning to FIG. 2, gain smoother module 212 may be employed to reduce any variations in first gain Gain1 and second gain Gain2. As mentioned previously, the values for first gain Gain1 and second gain Gain2 may vary depending on whether signal level estimation SL(k,n) corresponds to an expander case, a compressor case, or a case with no compression effects. Gain smoother module 212 may implement gain smoothing using Equation 8:

$$g(k,n)=g(k,n-1)+\alpha_k\times(\text{Gain2}(k,n)-g(k,n-1)) \quad \text{Equation 8.}$$

In Equation 8, $\alpha_k$ may be referred to as a gain smoothing factor having a value ranging between 0.0 and 1.0 (e.g., $0.0<\alpha_k<1.0$). For example, for time constant 30 milliseconds at a 48 kHz sampling rate, the gain smoothing factor may have a value of $\alpha_k=0.0015278$. In some embodiments, different frequency bands corresponding to different filtered audio signals may have different values for gain smoothing factor $\alpha_k$. Furthermore, in Equation 8, g (k,n) may correspond to an amount of adaptive audio gain to be applied to a particular audio frame of a delayed audio signal generated by delay module 216.

At block 214 of mono MBDP system 200, adaptive audio gain g(k,n) may be applied to a corresponding delayed audio signal. In particular, the amount of adaptive audio gain g(k,n) may be applied to a delayed audio signal's input samples I(k,(n−1)×L−D+i), where i corresponds to the 1-th audio sample, and may range between zero and L−1 (e.g., 1=0, 1, . . . ,L−1). For example, the amount of the logarithmic representation may be multiplied by the corresponding delayed audio signal to generated the processed audio signal. Block 214 may therefore generate a processed audio signal sOut(k,n,i) for each frequency band using Equation 9:

$$s\text{Out}(k,n,i)=g(k,n)\times I(k,(n-1)\times L-D+i) \quad \text{Equation 9.}$$

For example, first filtered audio signal 222*a* corresponding to a first frequency band (e.g., k=1), may produce first processed audio signal 224*a* in response to having adaptive audio gain g(k,n) applied to its corresponding delayed audio signal. Similarly, second filtered audio signal 222*b* corresponding to a second frequency band (e.g., k=2 or k=N) may produce second processed audio signal 224*b* in response to adaptive audio gain g(k,n) being applied to its corresponding delayed audio signal. Persons of ordinary skill in the art will recognize that the number of processed audio signals produced at blocks 214 depends, as mentioned previously, on the number of filtered audio signals generated by filter bank 204, and the aforementioned example of two processed audio signals that are generated, first processed audio signal 224*a* and second processed audio signal 224*b*, correspond to the exemplary scenario where two filtered audio signal, first filtered audio signal 222*a* and second filtered audio signal 222*b*, are generated by filter bank 204. Furthermore, persons of ordinary skill in the art will also recognize that the delay time of each of the delayed audio signals produced by delay module 216 should be substantially similar. For example, if the delay time of filtered audio signal 222*a* caused by delay module 216 is delay value D, where D is in units of samples, then the delay time of filtered audio signal 222*b* should also be equal to delay value D.

At block 218, the processed audio signals for each of the various frequency bands may be summed together to generate a full-band output audio signal 226. For example, first processed audio signal 224*a* of a first frequency band, and second processed audio signal 224*b* of a second frequency band, may be summed together. As another example, if filter bank 204 generates N filtered audio signals (e.g., k=1, 2, . . . N), then the N filtered audio signals may be summed together at block 218. Full-band output audio signal 226, in some embodiments, may be expressed using Equation 10:

$$s\text{Output}(n,i)=\Sigma_{k=1}^{N}s\text{Out}(k,n,i) \qquad \text{Equation 10.}$$

In some embodiments, full-band output audio signal 226 may then be provided to limiter block 220. Limiter block 220 may correspond to any suitable audio limiter for preventing amplitude peaks in full-band output audio signal 226 from exceeding positive and negative maximum amplitude limits. For instance, limiter block 220 may suppress any portion of the processed audio signal that has a peak that is greater than an upper amplitude limit or less than a lower amplitude limit. Limiter block 220 may, for instance, attenuate full-band output audio signal 226 such that any peaks of full-band output audio signal 226 remain within the maximum amplitude limits. This may ensure that final output audio signal 228 does not damage any circuitry or components of electronic device 100, for instance. Furthermore, by applying limiter block 220 the total harmonic distortion for final output audio signal 228 may be reduced.

Figure 6:
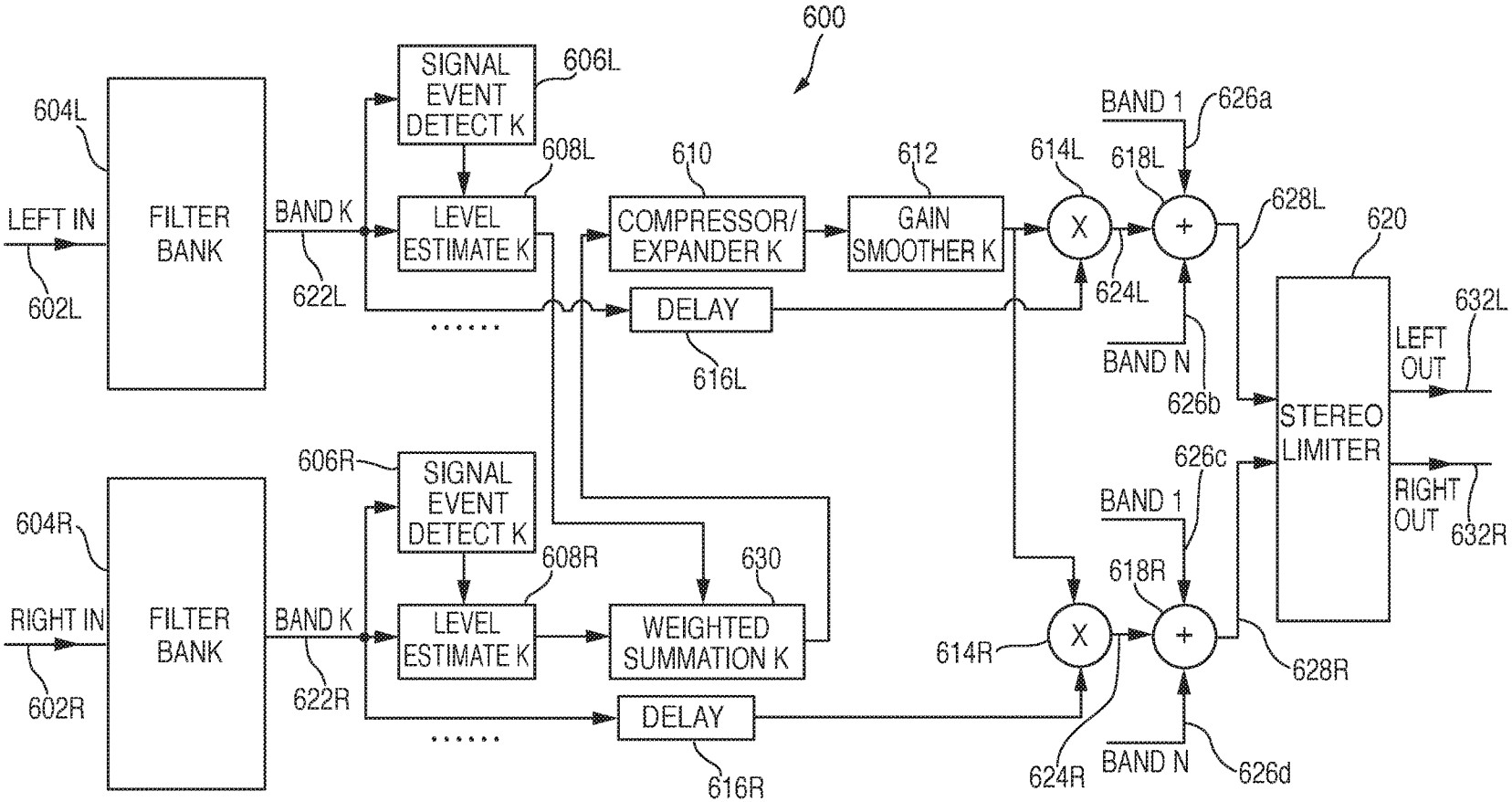
FIG. 6 is an illustrative schematic of a stereo multi-band dynamics processor, in accordance with various embodiments.

FIG. 6 is an illustrative schematic of a stereo multi-band dynamics processor, in accordance with various embodiments. Stereo MBDP system 600, in some embodiments, corresponds to a dynamically reconfigurable stereophonic sound system, where the output audio creates the perception of being multi-directional. Stereo MBDP system 600, in some embodiments, may be included within electronic device 100. For example, stereo MBDP system 600 may be stored within storage/memory 104. However, instead of receiving a single audio input signal 202, as may be the case for mono MBDP system 200 of FIG. 2, stereo MBDP system 600 may receive two audio input signals—a left audio input signal 602L and a right audio input signal 602R.

Stereo MBDP system 600 may include a left filter bank 604L and a right filter bank 604R. Left audio input signal 602L may, accordingly, be received by left filter bank 604L, while right audio input signal 602R may be received by right filter bank 604R. Each of left filter bank 604L and right filter bank 604R may be similarly configured such that they split their respective audio input signals into a similar number of filtered audio signals corresponding to a similar number and type of frequency band. In some embodiments, left filter bank 604L may split left audio input signal 602L into N filtered audio signals corresponding to N different frequency bands (e.g., frequency band k=1,2 . . . N), and right filter bank 604R may similarly split right audio input signal 602R into N filtered audio signals corresponding to the same N different frequency bands. As an illustrative example, left filter bank 604L may split left audio input signal 602L into three filtered audio signals (e.g., N=3) for three frequency bands, a first frequency band (e.g., k=1), a second frequency band (e.g., k=2), and a third frequency band (e.g., k=3). Right filter bank 604R may, therefore, also split right audio input signal 602R into three filtered audio signals for the same three frequency bands (e.g., k=1, k=2, and k=3).

In the illustrative embodiment, a left filtered audio signal 622L may be generated in response to left audio input signal 602L being applied to left filter bank 604L, while right filtered audio signal 622R may be generated in response to right audio input signal 602R being applied to right filter bank 604R. Both left filtered audio signal 622L and right filtered audio signal 622R may correspond to a same frequency band (e.g., frequency band k), in the example embodiment. However, persons of ordinary skill in the art will recognize that although only a single filtered audio signal is shown to be generated by filter banks 604L and 604R, multiple filtered audio signals (e.g., N filtered audio signals) may be produced by both filter banks 604L and 604R, and the aforementioned is merely exemplary. For example, left filter bank 604L may produce five filtered audio signals corresponding to five different frequency bands. In this example, right filter bank 604R may also produce five filtered audio signals that also correspond to the same five frequency bands.

Each of left filtered audio signal 622L and right filtered audio signal 622R, as well as any other filtered audio signals produced by filter banks 604L and 604R, may be provided to a corresponding signal event detector module 606L and 606R. In some embodiments, the filtered audio signals 622L and 622R, or any other filtered audio signals produced by either of left filter bank 604L or right filter bank 604R, may be delayed by a delay time D using delay modules 616L and 616R, respectively. Delay modules 616L and 616R may delay the filtered audio signals such that any latency due to determining an amount of adaptive gain to apply to the filtered audio signals. For example, the delay time may be only a few milliseconds, however any suitable delay time may be used. Both of delay modules 616L and 616R may be configured similarly to delay module 216 of FIG. 2, and the previous description of delay module 216 may apply to delay modules 616L and 616R. Therefore, left filtered audio signal 622L, as well as any other left filtered audio signals produced by left filter bank 604L, may be delayed by delay time D using delay module 616L, and right filtered audio signal 622R, as well as any other right filtered audio signals produced by right filter bank 604R, may also be delayed by delay time D using delay module 616R.

Filtered audio signals 622L and 622R, as well as any other additional filtered audio signals produced by filter banks 604L and 604R, may be provided to signal event detector modules 606L and 606R, respectively, in addition to being delayed by delay module 616L and 616R, respectively. Furthermore, in some embodiments, filtered audio signals 622L and 622R, as well as any other additional filtered audio signals produced by filter banks 604L and 604R, may be provided to signal level estimation modules 608L and 608R at a substantially same time as they are provided to signal event detector modules 606L and 606R, respectively. In some embodiments, a copy of filtered audio signals 622L and 622R may be provided to signal event detector modules 606L and 606R, and a copy of filtered audio signals 622L and 622R may be provided to signal level estimation modules 608L and 608R, while the original versions of filtered audio signals 622L and 622R are provided to delay modules 616L and 616R, however this is merely exemplary. Furthermore, if filter banks 604L and 604R generate N filtered audio signals corresponding to N frequency bands, then each of the N filtered audio signals may be applied to a corresponding signal event detector module 606L, 606R, and signal level estimation module 608L, 608R. For example, if filter banks 604L and 604R split audio input signals 602L and 602R into three left filtered audio signals of three frequency bands (e.g., k=1, k=2, and k=3), and three right filtered audio signals of the same three frequency bands, then there may be three instances of signal event detector module 606L and three instances of signal event detector module 606R for each of the three left filtered audio signals and the three of the right filtered audio signals.

Signal event detector modules 606L and 606R, in some embodiments, may determine whether filtered audio signals 622L and 622R, respectively, include one or more instances of an audio event (e.g., voice, speech, sound) or a non-audio event (e.g., silence or noise). For example, each of filtered audio signals 622L and 622R may include one or more instances of speech, silence, or noise. Signal event detector modules 606L and 606R may, therefore, analyze filtered audio signals 622L and 622R, as well as any other filtered audio signals generated by filter banks 604L and 604R, to determine whether a particular filtered audio signal of a particular frequency band includes an audio event or a non-audio event. Both of signal event detector modules 606L and 606R may be configured similarly to signal event detector module 206 of FIG. 2, and the aforementioned description may apply. Furthermore, as filter banks 604L and 604R may produce N filtered audio signals corresponding to N frequency bands, each of signal event detector modules 606L and 606R may be configured to determine whether any of the N left filtered audio signals or the N right filtered audio signals include instances of audio events or non-audio events. In some embodiments, process 300 of FIG. 3 may be employed by signal event detector modules 606L and 606R to determine whether an audio frame of a filtered audio signal includes an audio event or a non-audio event.

In parallel with or after signal event detector modules 606L and 606R determine whether or not the left and right filtered audio signals for a particular frequency band includes an audio event or a non-audio event, a signal level estimation may be performed by signal level estimation modules 608L and 608R. Signal level estimation modules 608L and 608R, in some embodiments, may be used to determine a particular function of compressor/expander module 610. For example, depending on the signal level estimation determined by signal level estimation modules 608L and/or 608R, compressor/expander module 610 may function as a compressor, an expander, or may function with no compression effects. Compressor/expander module 610 may then be used to determine an amount of adaptive audio gain to apply for gain smoothing by gain smoother 612. In some embodiments, the signal level estimation and determination of whether that signal level corresponds to a compressor, expander, or linear case may be described by process 400 of FIG. 4.

In some embodiments, stereo MBDP system 600 may include a weighted summation module 630. Upon determining the signal level estimation for each of filtered audio signals 622L and 622R, the signal level estimations may be provided to weighted summation module 630. Weighted summation module 630 may, in the exemplary embodiment, generate an average of the signal level estimations for each frequency band, which in turn may be used by compressor/expander module 610. Weighted summation module 630 may determine the average signal level estimation using Equation 11:

$$WeightedSummation(k, n) = \frac{1}{2}[SL_{Left}(k, n) + SL_{Right}(k, n)]. \quad \text{Equation 11}$$

Compressor/Expander module 610, in some embodiments, may employ process 400 of FIG. 4 to determine an amount of adaptive audio gain to use for gain smoother module 612 based on WeightedSummation(k,n). In this way, filtered audio signals of the same frequency band across the left and right channels may receive a same amount of adaptive audio gain. In some embodiments, compressor/expander module 610 and gain smoother module 612 of stereo MBDP system 600 may be substantially similar to compressor/expander module 210 and gain smoother module 212 of mono MBDP system 200 of FIG. 2, and the previous description may apply. In some embodiments, mono MBDP system 200 may allow for different frequency bands to have different values for compression ratios R1 and R2, expander threshold value Th1, compressor threshold value Th2, and user adjustable gain G, however all frequency bands should have the same value for base constant B. Stereo MBDP system 600, may be configured such that each frequency band of the different channels have the same values for compression ratios R1 and R2, expander threshold value Th1, compressor threshold value Th2, and user adjustable gain G. For example, frequency band 1 (e.g., k=1) of both the left channel and the right channel should have the same values for compression ratios R1 and R2, expander threshold value Th1, compressor threshold value Th2, and user adjustable gain G. However, these values may differ from the compression ratios R1 and R2, expander threshold value Th1, compressor threshold value Th2, and user adjustable gain G for frequency band 2 (e.g., k=2) across the left channel and the right channel.

At block 614L of stereo MBDP system 600, the amount of adaptive audio gain may be applied to the delayed left audio signal(s), and at block 614R of stereo MBDP system 600, that same amount of adaptive audio gain may be applied to the delayed right audio signal(s). Block 614L may generate left processed audio signal 624L for each frequency band, and block 614R may generate right processed audio signal 624R for each frequency band. For example, if N filtered audio signals were produced by both left filter bank 604L and right filter bank 604R, then block 614L may generate N left processed audio signals, and block 614R may generate N right processed audio signals. Each of blocks 614L and 614R may generate the processed audio signals for each frequency band using Equation 9. As mentioned previously, mono MBDP system 200 of FIG. 2 may include different values for factor $\alpha_k$ across the different frequency bands (e.g., for k=1, $\alpha_k=\alpha_1$; for k=2, $\alpha_k=\alpha_2$; etc.). However, for stereo MBDP system 600, each corresponding frequency band across the different channels should have the same value for factor $\alpha_k$. For example, frequency band 1 (e.g., k=1) may have $\alpha_k=\alpha_1$, and therefore frequency band 1 of both the right and left channels would have factor $\alpha_k=\alpha_1$. However, frequency band N may have $\alpha_k=\alpha_N$ such that frequency band N of both the left and right channels use factor $\alpha_k=\alpha_N$.

At block 618L, processed audio signals 624L may be summed together for frequency bands 1 through N to generate a left full-band output audio signal 634L. Similarly, at block 618R, the processed audio signals 624R for frequency bands 1 through N may be summed together to generate a right full-band output audio signal 634R. In some embodiments, processed audio signals 624L and 624R may include N different processed audio signals corresponding to N different frequency bands. For example, processed audio signal 624L may include processed audio signal 626*a* corresponding to frequency band k=1 up to processed audio signal 626*b* corresponding to frequency band k=N. Similarly, processed audio signal 624R may include processed audio signal 626*c* corresponding to frequency band k=1 up to processed audio signal 626*d* corresponding to frequency band k=N. Although only two processed audio signals corresponding to a first frequency band and an N-th frequency band are shown for both the left and right channel, persons of ordinary skill in the art will recognize that processed audio signals 624L and 624R may be representative of any number of processed audio signals, and the aforementioned is merely illustrative. Full-band output audio signals 628L and 628R, in some embodiments, may be generated using Equation 10.

In some embodiments, full-band output audio signals 628L and 628R may then be applied to stereo limiter block 620. Stereo limiter block 620 may correspond to any suitable audio limiter for preventing amplitude peaks in audio signals from exceeding positive and negative maximum amplitude limits. In some embodiments, stereo limiter block 620 may be substantially similar to limiter block 220 of mono MBDP system 200 of FIG. 2, with the exception that stereo limiter block 620 may correspond to a multi-channel audio system. Stereo limiter block 620 may, for instance, attenuate full-band output audio signals 628L and 628R such that any peaks of full-band output audio signal 628L and 628R remain within the maximum amplitude limits (e.g., an upper amplitude limit and a lower amplitude limit). After providing full-band output audio signals 628L and 628R to stereo limiter block 620, a final output audio signals 632L and 632R may be generated, such that final output audio signals 632L and 632R do not damage any circuitry or components of electronic device 100, for instance.

Figure 7:
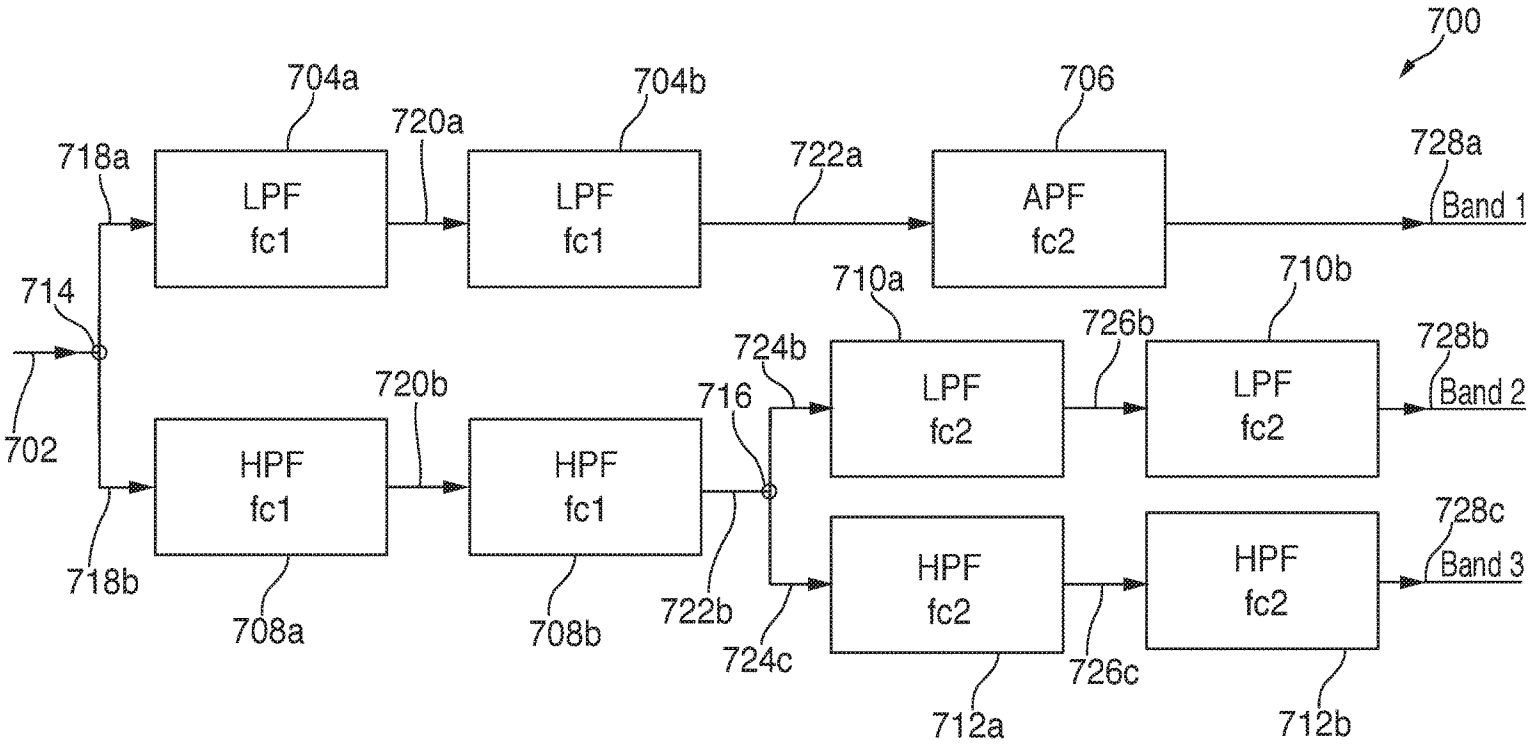
FIG. 7 is an illustrative schematic of an exemplary filter band for use within a multi-band dynamics processor, in accordance with various embodiments.

FIG. 7 is an illustrative schematic of an exemplary filter band for use within a multi-band dynamics processor, in accordance with various embodiments. Filter bank 700, in some embodiments, is configured to split an audio input signal 702, such as audio input signal 202 or left audio input signal 302L and right audio input signal 302R, into two or more filtered audio signals of different frequency bands. Filter bank 700 of FIG. 7 is one non-limiting embodiment of a three-band filter bank (e.g., N=3). For example, a first filtered audio signal 728*a* of frequency band 1, a second filtered audio signal 728*b* of frequency band 2, and a third filtered audio signal 728*c* of frequency band 3 may be generated using audio input signal 702.

At point 714, audio input signal 702 may be split into two signals 718*a* and 718*b*, each substantially similar to one another. Signal 718*a* may be initially provided to a low-pass filter 704*a*, whereas signal 718*b* may initially be provided to a high-pass filter 708*a*. A low-pass filter is a filter that only allows frequencies lower than a certain cutoff frequency to pass through it, whereas a high-pass filter is a filter that only allows frequencies above a certain cutoff frequency to pass through. Low-pass filters 704*a* and 704*b*, in one illustrative embodiment, may be a second-order Butterworth low-pass filter having a crossover frequency fc1. High-pass filters 708*a* and 708*b*, in the illustrative embodiment, may be a second-order Butterworth high-pass filter also having a crossover frequency fc1.

In some embodiments, signal 718*a* may be processed by a first low-pass filter 704*a* producing signal 720*a*, which may then be received by a second low-pass filter 704*b* producing signal 722*a*. First low-pass filter 704*a* and second low-pass filter 704*b* may, in one embodiment, be configured substantially similar to one another such that they have a substantially same phase response due to each having the same crossover frequency fc1. In some embodiments, signal 718*b* may be processed by a first high-pass filter 708*a* producing signal 720*b*, which may then be received by a second high-pass filter 708*b* producing signal 722*b*. First high-pass filter 708*a* and second high-pass filter 708*b* may, in one embodiment, be substantially similar such that they have a same phase response due to having the same crossover frequency fc1. Although both first low-pass filter 704*a* and second low-pass filter 704*b* are included within filter bank 700, persons of ordinary skill in the art will recognize that any number of similarly configured low-pass filters (e.g., a low-pass filter having crossover frequency fc1) may be employed within filter bank 700, and the aforementioned use of two low-pass filters 704*a* and 704*b* is merely exemplary.

In some embodiments, signal 722*a* may be received by an all-pass filter 706. An all-pass filter, for example, may correspond to a filter that allows all frequencies to pass through, but may change a phase relationship of the signal. All-pass filter 706 may be configured such that it has a crossover frequency fc2, and produces a signal 728*a* of frequency band 1 which is in-phase with signals 728*b* and 728*c* of frequency bands 2 and 3, respectively. All-pass filter 706, furthermore, may correspond to a Butterworth all-pass filter.

In some embodiments, signal 722*b* may be split again at point 716. For example, signal 722*b* may be split into signal 724*b* and 724*c*, which may be substantially similar to one another. Signal 724*b* may be provided to a low pass filter 710*a*, while signal 724*c* may be provided to a high-pass filter 712*a*. Low-pass filter 710*a* may generate a signal 726*b* in response to receiving signal 724*b*, which may then be provided to another low-pass filter 710*b*. Low-pass filter 710*b* may produce filtered audio signal 728*b*, which may be of frequency band 2 (e.g., k=2). High-pass filter 712*a* may, in response to receiving signal 724*c*, may produce signal 726*c*. Signal 726*c* may then be provided to a high-pass filter 712*b*, which generates filtered audio signal 728*c* of frequency band 3 (e.g., k=3). Each of low-pass filters 710*a* and 710*b*, and high-pass filters 712*a* and 712*b* may be configured similarly to low pass filters 704*a*, 704*b* and high-pass filters 708*a*, 708*b*, respectively, with the exception that low-pass filters 710*a* and 710*b*, and high-pass filters 712*a* and 712*b* may have a crossover frequency fc2. Persons of ordinary skill in the art will recognize that although two instances of low-pass filters 704*a* and 704*b* with crossover frequency fc1, two instances of high-pass filters 708*a* and 708*b* with crossover frequency fc1, two instances of low-pass filters 710*a* and 710*b* with crossover frequency fc2, and two instances of high-pass filters 712*a* and 712*b* with crossover frequency fc2 are each provided in series with one another, this is merely exemplary, and any number of low-pass filters or high-pass filters, and any arrangement of low-pass filters and high-pass filters, may be used by filter bank 700, and the aforementioned is merely exemplary.

Filter bank 700 may similarly be configured to generate any number of filtered audio signals of any number of frequency bands. Furthermore, filter bank 700 may be employed within any suitable MBDP system. For example, filter bank 700 may correspond to filter bank 204, or filter bank 700 may correspond to left filter bank 304L and right filter bank 304R. Filter bank 700 may further be configured such that each of the filtered audio signals produced thereby (e.g., filtered audio signals 728*a-c*), are in-phase with one another. For instance, filtered audio signals 728*a*, 728*b*, and 728*c* may reconstruct audio input signal 702 substantially perfectly, thereby producing a filter bank having a very high signal-to-noise ratio.

Figure 8:
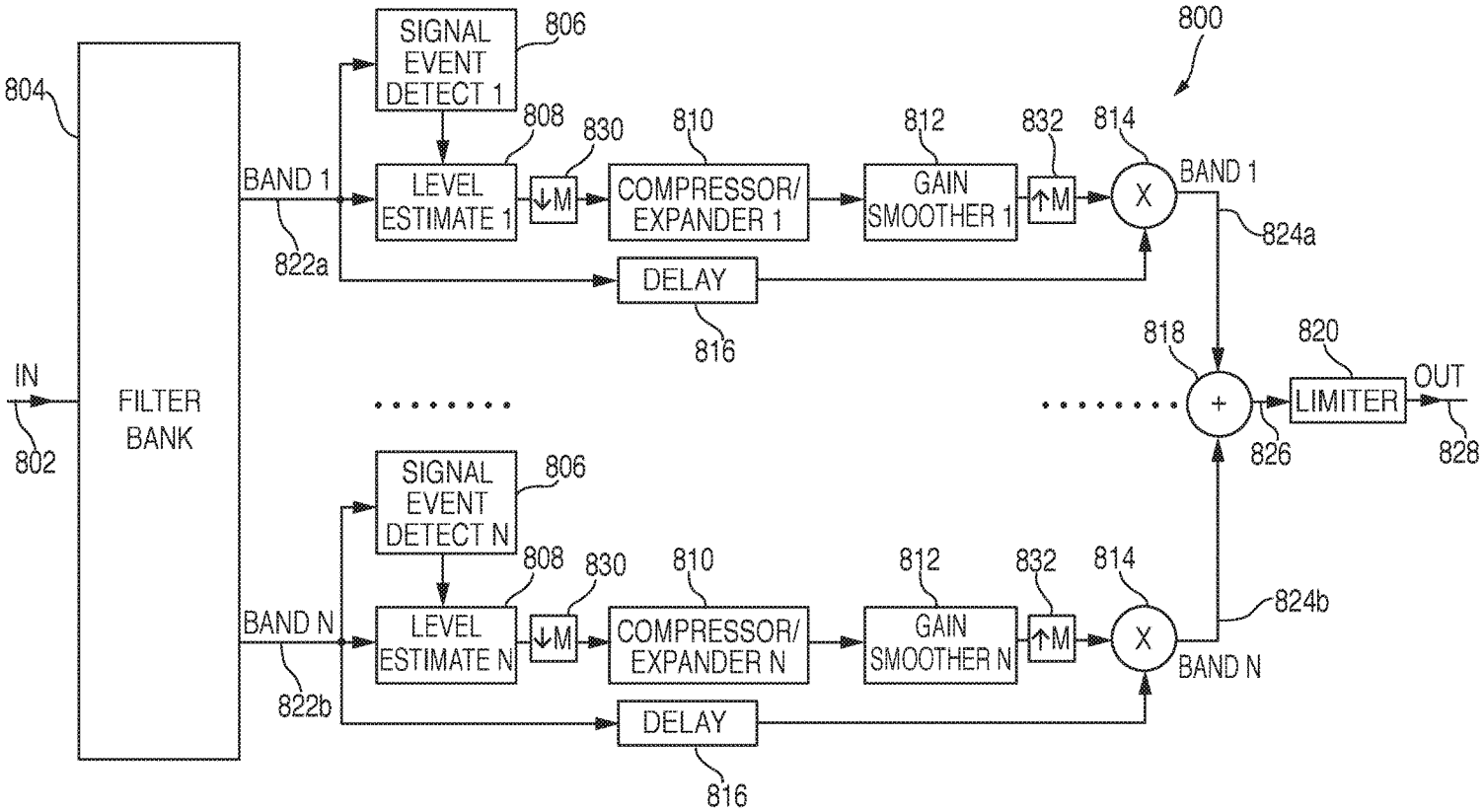
FIG. 8 is an illustrative schematic of another mono multi-band dynamics processor for use with a low-powered electronic device, in accordance with various embodiments.

FIG. 8 is an illustrative schematic of another mono multi-band dynamics processor for use with a low-powered electronic device, in accordance with various embodiments. Mono MBDP system 800, in some embodiments, may be substantially similar to mono MBDP system 200 of FIG. 2, with the exception that mono MBDP system 800 may also include a predefined sampling rate reduction block 830 and a sampling rate increase block 832. If electronic device 100 corresponds a low-powered electronic device, such as a battery operated electronic device, the computational capacity of electronic device 100 may be less than that of a non-low-powered electronic device. Thus, in this particular embodiment, a reduction in the computational complexity may be applied to reduce an amount of computation performed by system 800 of electronic device 100 to minimize power draw for reducing IM effects.

In some embodiments, audio input signal 802 may be received by filter bank 804 of mono MBDP system 800. As mentioned previously, audio input signal 802 may be a wideband audio signal encompassing multiple frequencies, and filter bank 804 may be configured to split audio input signal 802 into N filtered audio signals. For example, filter bank 804 may split audio input signal 802 into first filtered audio signal 822*a* and second filtered audio signal 822*b*, where first filtered audio signal 822*a* is of a first frequency band, and second filtered audio signal 822*b* is of an N-th frequency band.

Each of first filtered audio signal 822*a* and second filtered audio signal 822*b* may then be delayed by a delay time D using delay module 816. Delay module 816 may delay the filtered audio signals such that any latency due to determining an amount of adaptive gain to apply to the filtered audio signal may be accounted for. For example, delay time D may be only a few milliseconds, however any suitable delay time may be used. In some embodiments, filter bank 804 may be substantially similar to filter bank 204 of mono MBDP system 200, or filter bank 700 of FIG. 7, and the previous descriptions may apply.

The filtered audio signals, in addition to being delayed by delay module 816, may be provided to signal event detector module 806 as well as signal level estimation module 808. In some embodiments, a copy of filtered audio signals 822*a* and 822*b*, as well as any other filtered audio signals produced by filter bank 804, may be provided to signal event detector module 806 and signal level estimation module 808, while the original filtered audio signal is provided to delay module 816, however this is merely exemplary. Furthermore, for each filtered audio signal (e.g., filtered audio signals 822*a* and 822*b*), there may be a respective signal event detector 806 and signal level estimation module 808. Signal event detector module 806, in some embodiments, may determine a type of signal that is included within the respective filtered audio signal that is provided thereto. Furthermore, in the illustrative embodiment, signal event detector module 806 may be substantially similar to signal event detector 206 of mono MBDP system 200, and the previous description may apply.

In parallel to, or after, signal event detector module 806 determines whether or not the filtered audio signal for a particular frequency band includes an audio event or a non-audio event, a signal level estimation may be performed by signal level estimation module 808. Signal level estimation module 808, in some embodiments, may be substantially similar to signal level estimation module 208 of FIG. 2, and the previous description may also apply.

In order to reduce the computational resources for the low-powered electronic device (e.g., electronic device 100), sampling rate reduction block 830 may be employed to reduce a sampling rate used for determining the adaptive gain amount to apply for gain smoothing by gain smoother 812, based on the determined function of compressor/expander module 810. For example, sampling rate reduction block 830 may reduce the sampling rate such that every other audio frame, or every third audio frame, or every j-th audio frame is analyzed, as opposed analyzing each audio frame of each filtered audio signal. In some embodiments, sampling rate reduction block 830 may be employed prior to signal event detector module 806, or prior to signal level estimation module 808, and the aforementioned configuration of mono MBDP system 800 is merely exemplary.

In some embodiments, sampling rate reduction block 830 may be dynamically configured such that it reduces the number of audio frames analyzed based on an amount of remaining battery power of electronic device 100. For example, if electronic device 100 has full battery power, a first predefined sampling rate reduction factor may be applied by sampling rate reduction block 830. As electronic device 100 has less battery power, the sampling rate reduction factor may increase. For example, if electronic device 100 has only 50% battery power remaining, a second sampling rate reduction factor may be employed by sampling rate reduction block 830. Further still, as the battery power of electronic device 100 reaches a critical level (e.g., less than 20% battery power remaining), the sampling rate reduction factor may be increased to analyze a minimum number of audio frames.

After the sampling reduction is applied, a determination may be made as to whether or not compressor/expander module 810 should function as a compressor, an expander, or with no compression effects. Compressor/expander module 810, in some embodiment, may be substantially similar to compressor/expander module 210 of FIG. 2, and the previous description may apply. Using compressor/expander module 810, an amount of adaptive audio gain to apply for gain smoothing by gain smoother 812 may be determined. In some embodiments, the signal level estimation and determination of whether that signal level corresponds to a compressor, expander, or linear case may be determined using process 400 of FIG. 4.

After the appropriate amount of adaptive audio gain is applied by gain smoother 812, sampling rate increase block 832 may increase the sampling rate of the audio signal by a predefined sampling rate increase factor such that the original sampling rate of filtered audio signal 822*a* or 822*b* is restored. For example, if sampling rate reduction block 830 reduces the sampling rate by a factor M, then sampling rate increase block 832 may increase the sampling rate for the filtered audio signals of each frequency band (e.g., filtered audio signals 822*a*, 822*b*) by a predefined sampling rate increase factor, such as factor M.

At block 814, a processed audio signal for each frequency band may be generated. In some embodiments, the amount of adaptive audio gain may be applied to the delayed audio signals from delay module 816, which was determined using reduction factor M, using Equation 9. For example, processed audio signals 824*a* and 824*b* may be generated by block 814 for the various frequency bands. At block 818, the processed audio signals may be summed together using Equation 10, thereby generating full-band audio output signal 826. Furthermore, in some embodiments, full-band audio output signal 826 may be applied to limiter 820, thereby generating final audio output signal 828. Persons of ordinary skill in the art will recognize that blocks 814 and 818, limiter 820, audio signal 802, filtered audio signals 822*a* and 822*b*, processed audio signals 824*a* and 824*b*, full-band audio output signal 826, and final audio output signal 828 may be substantially similar to blocks 214 and 218, limiter 220, audio signal 202, filtered audio signals 222*a* and 222*b*, processed audio signals 224*a* and 224*b*, full-band audio output signal 226, and final audio output signal 228 of mono MBDP system 200, and the previous description may apply. Furthermore, sampling rate reduction block 830 and sampling rate increase block 832 may also be employed within a multi-channel system, such as stereo MBDP system 600 of FIG. 6. Further still, systems 200, 600, and/or 800 may also be used in conjunction with other MBDP systems to assist in the removal of overshoots from those other MBDP systems.

Figure 9:
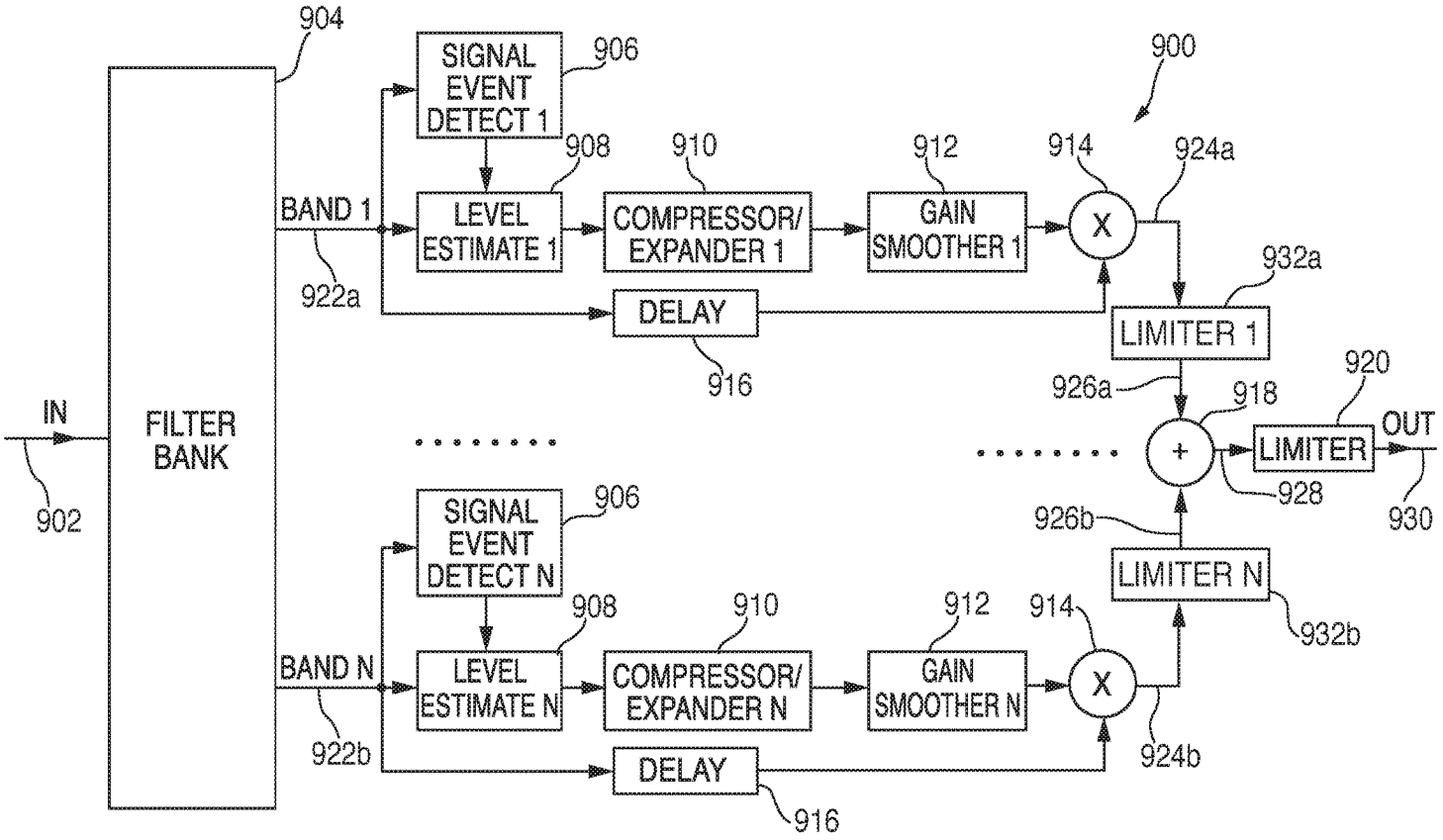
FIG. 9 is an illustrative schematic of another mono multi-band dynamics processor including multi-band limiters, in accordance with various embodiments.

FIG. 9 is an illustrative schematic of another mono multi-band dynamics processor including multi-band limiters, in accordance with various embodiments. Mono MBDP system 900, in some embodiments, may be substantially similar to mono MBDP system 200 of FIG. 2, with the exception that mono MBDP system 900 may include limiter for each frequency band such that each processed audio signal is applied to the limiter prior to being summed together. For instance, peaks generated by gain smoother module 912 may be suppressed by multi-band limiters 932*a* and 932*b* prior to summing across all frequency bands at block 918. Multi-band limiters 932*a* and 932*b* may be configured to prevent electronic device 100, which may have mono MBDP system 900 implemented therein, from drawing too much power due to large peaks within a processed audio signal.

In some embodiments, audio input signal 902 may be received by filter bank 904 of mono MBDP system 900. As mentioned previously, audio input signal 902 may be a wideband audio signal encompassing multiple frequencies, and filter bank 904 may be configured to split audio input signal 902 into N filtered audio signals. For example, filter bank 904 may split audio input signal 902 into first filtered audio signal 922*a* and second filtered audio signal 922*b*, where first filtered audio signal 922*a* is of a first frequency band, and second filtered audio signal 922*b* is of an N-th frequency band.

Each of first filtered audio signal 922*a* and second filtered audio signal 922*b* may then be delayed by a delay time D using delay module 916. Delay module 916 may delay the filtered audio signals such that any latency due to determining an amount of adaptive gain to apply to the filtered audio signal may be accounted for. For example, delay time D may be only a few milliseconds, however any suitable delay time may be used. In some embodiments, filter bank 904 may be substantially similar to filter bank 204 of mono MBDP system 200, or filter bank 700 of FIG. 7, and the previous descriptions may apply.

The filtered audio signals, in addition to being delayed by delay module 916, may be provided to signal event detector module 906 as well as signal level estimation module 908. In some embodiments, a copy of filtered audio signals 922*a* and 922*b*, as well as any other filtered audio signals produced by filter bank 904, may be provided to signal event detector module 906 and signal level estimation module 908, while the original filtered audio signal is provided to delay module 916, however this is merely exemplary. Furthermore, for each filtered audio signal (e.g., filtered audio signals 922*a* and 922*b*), there may be a respective signal event detector 906 and signal level estimation module 908. Signal event detector module 906, in some embodiments, may determine a type of signal that is included within the respective filtered audio signal that is provided thereto. Furthermore, in the illustrative embodiment, signal event detector module 906 may be substantially similar to signal event detector 206 of mono MBDP system 200, and the previous description may apply.

In parallel to, or after, signal event detector module 906 determines whether or not the filtered audio signal for a particular frequency band includes an audio event or a non-audio event, a signal level estimation may be performed by signal level estimation module 908. Signal level estimation module 908, in some embodiments, may be substantially similar to signal level estimation module 208 of FIG. 2, and the previous description may also apply.

A determination may then be made as to whether or not compressor/expander module 910 should function as a compressor, an expander, or with no compression effects. Compressor/expander module 910, in some embodiment, may be substantially similar to compressor/expander module 210 of FIG. 2, and the previous description may apply. Using compressor/expander module 910, an amount of adaptive audio gain to apply for gain smoothing by gain smoother 912 may be determined. In some embodiments, the signal level estimation and determination of whether that signal level corresponds to a compressor, expander, or linear case may be determined using process 400 of FIG. 4.

At block 914, a processed audio signal for each frequency band may be generated. In some embodiments, the amount of adaptive audio gain may be applied to the delayed audio signals from delay module 916, which was determined using reduction factor M, using Equation 9. For example, processed audio signals 924*a* and 924*b* may be generated by block 914 for the various frequency bands. Processed audio signals 924*a* and 924*b* may then be provided to multi-band limiters 932*a* and 932*b*, respectively. Multi-band limiters 932*a* and 932*b* may be configured to suppress peaks generated by compressor/expander module 910. For example, multi-band limiters 932*a* and 932*b* may attenuate portions of processed audio signals 924*a* and 924*b*, respectively, which exceed an upper or lower audio limit, which may be set by an individual operating electronic device 100 for limiters 932*a* and 932*b*. In some embodiments, multi-band limiters 932*a* and 932*b* may be configured to suppress peaks from processed audio signals 924*a* and 924*b* based on a corresponding peak's measure such that processed audio signals 924*a* and 924*b* are reduced as to prevent an overage of power being consumed by speaker(s) 210 of electronic device 100, and therefore damaging speaker(s) 210 and/or electronic device 100. Although only two multi-band limiters 932*a* and 932*b* are shown within mono MBDP system 900, persons of ordinary skill in the art will recognize that any number of multi-band limiters may be included depending on a number of filtered audio signals produced by filter bank 904. For example, if filter bank 904 generates N filtered audio signals, then there will be N processed audio signals produced at blocks 914, and accordingly there will be N multi-band limiters included for the N processed audio signals.

In the illustrative, non-limiting embodiment, multi-band limiters 926*a* and 926*b* may generate additionally processed audio signals 926*a* and 928*b*, respectively, which may be provided to block 918. At block 918, the additionally processed audio signals, such as additionally processed audio signals 926*a* and 926*b*, may be summed together using Equation 10, thereby generating full-band audio output signal 928. Furthermore, in some embodiments, full-band audio output signal 928 may be applied to limiter 920, thereby generating final audio output signal 930. Limiter 930 may, in some embodiments, be substantially similar to limiter 220 of FIG. 2 and/or limiters 932*a* and 932*b*, however this is merely exemplary. Limiter 930 may be configured to reduce an amount of total harmonic distortion present within full-band audio output signal 928 such that final audio output signal 930 has the total harmonic distortion included therein lessened such that no damage to any components of electronic device 100 (e.g., speakers 210), may occur. Persons of ordinary skill in the art will recognize that blocks 914 and 918, limiter 920, audio signal 902, filtered audio signals 922*a* and 922*b*, processed audio signals 924*a* and 924*b*, full-band audio output signal 928, and final audio output signal 930 may be substantially similar to blocks 214 and 218, limiter 220, audio signal 202, filtered audio signals 222*a* and 222*b*, processed audio signals 224*a* and 224*b*, full-band audio output signal 226, and final audio output signal 228 of mono MBDP system 200, respectively, and the previous descriptions may apply. In some embodiments, a sampling rate reduction block, such as sampling rate reduction block 830 of FIG. 8, and a sampling rate increase block, such as sampling rate increase block 832 of FIG. 8 may also be employed within mono MBDP system 900, and the previous descriptions may apply.

Figure 10:
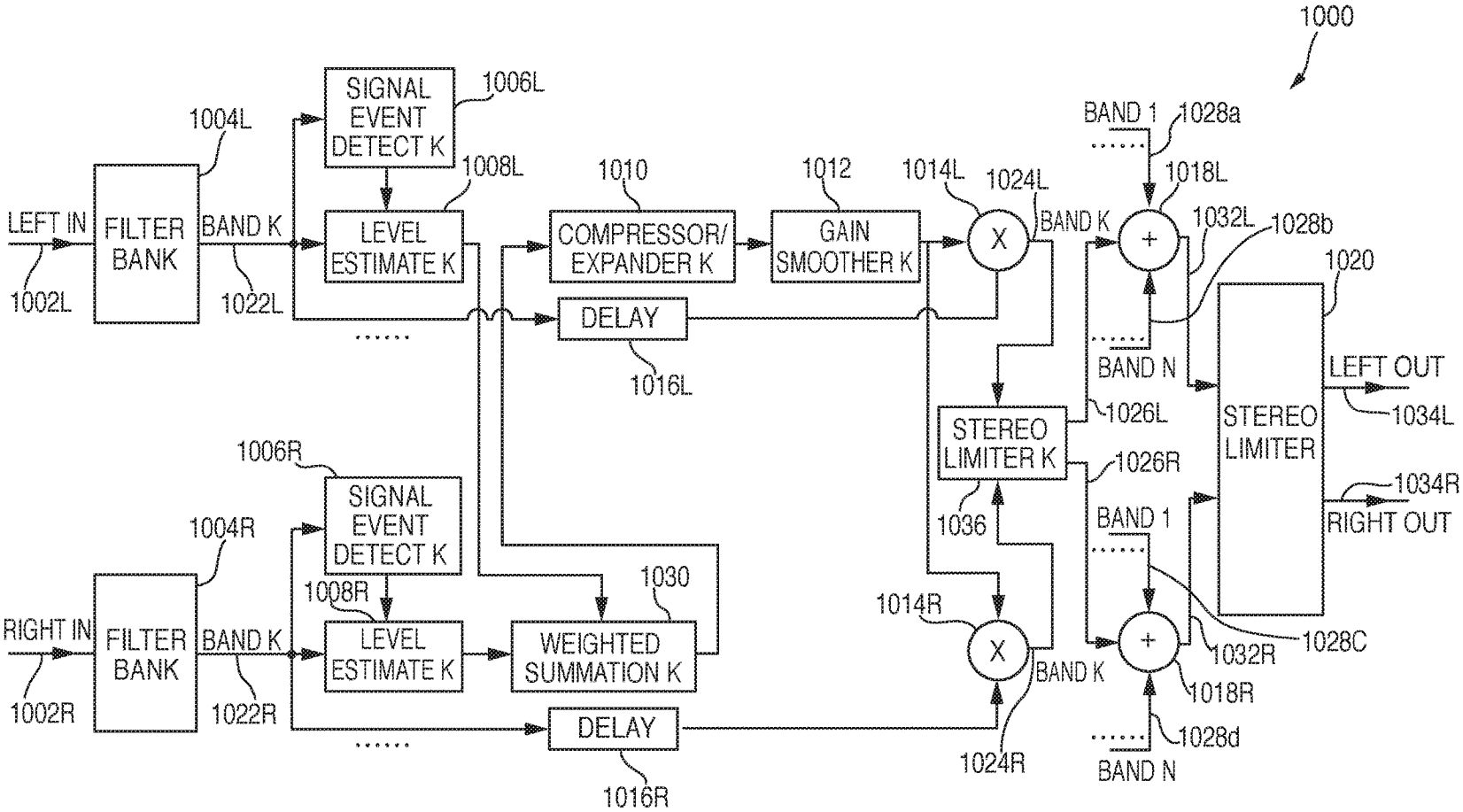
FIG. 10 is an illustrative schematic of another stereo multi-band dynamics processor including a stereo multi-band limiter, in accordance with various embodiments.

FIG. 10 is an illustrative schematic of another stereo multi-band dynamics processor including a stereo multi-band limiter, in accordance with various embodiments. Stereo MBDP system 1000, in some embodiments, may be substantially similar to stereo MBDP system 600, with the exception that stereo MBDP system 1000 may include a multi-band stereo limiter 1036 such that each processed audio signal is applied to limiter 1036 prior to being summed together. For instance, peaks generated by gain smoother module 1012 may be suppressed by multi-band stereo limiter 1036 prior to summing across all frequency bands at blocks 1018L and 1018R for a corresponding left and right channel, respectively. Multi-band stereo limiter 1036 may be configured to prevent electronic device 100, which may have stereo MBDP system 1000 implemented therein, from drawing too much power due to large peaks within a processed audio signal.

Stereo MBDP system 1000 may include a left filter bank 1004L and a right filter bank 1004R. Left audio input signal 1002L may, accordingly, be received by left filter bank 1004L, while right audio input signal 1002R may be received by right filter bank 1004R. Each of left filter bank 1004L and right filter bank 1004R may be similarly configured such that they split their respective audio input signals into a similar number of filtered audio signals corresponding to a similar number and type of frequency band. In some embodiments, left filter bank 1004L may split left audio input signal 1002L into N filtered audio signals corresponding to N different frequency bands (e.g., frequency band k=1,2 . . . N), and right filter bank 1004R may similarly split right audio input signal 1002R into N filtered audio signals corresponding to the same N different frequency bands. As an illustrative example, left filter bank 1004L may split left audio input signal 1002L into three filtered audio signals (e.g., N=3) for three frequency bands, a first frequency band (e.g., k=1), a second frequency band (e.g., k=2), and a third frequency band (e.g., k=3). Right filter bank 1004R may, therefore, also split right audio input signal 1002R into three filtered audio signals for the same three frequency bands (e.g., k=1, k=2, and k=3).

In the illustrative embodiment, a left filtered audio signal 1022L may be generated in response to left audio input signal 1002L being applied to left filter bank 1004L, while a right filtered audio signal 1022R may be generated in response to right audio input signal 1002R being applied to right filter bank 1004R. Both left filtered audio signal 1022L and right filtered audio signal 1022R may correspond to a same frequency band (e.g., frequency band k), in the example embodiment. However, persons of ordinary skill in the art will recognize that although only a single filtered audio signal is shown to be generated by filter banks 1004L and 1004R, multiple filtered audio signals (e.g., N filtered audio signals) may be produced by both filter banks 1004L and 1004R, and the aforementioned is merely exemplary. For example, left filter bank 1004L may produce five filtered audio signals corresponding to five different frequency bands. In this example, right filter bank 1004R may also produce five filtered audio signals that also correspond to the same five frequency bands.

Each of left filtered audio signal 1022L and right filtered audio signal 1022R, as well as any other filtered audio signals produced by filter banks 1004L and 1004R, may be provided to a corresponding signal event detector module 1006L and 1006R. In some embodiments, the filtered audio signals 1022L and 1022R, or any other filtered audio signals produced by either of left filter bank 1004L or right filter bank 1004R, may be delayed by a delay time D using delay modules 1016L and 1016R, respectively. Delay modules 1016L and 1016R may delay the filtered audio signals such that any latency due to determining an amount of adaptive gain to apply to the filtered audio signals. For example, the delay time may be only a few milliseconds, however any suitable delay time may be used. Both of delay modules 1016L and 1016R may be configured similarly to delay module 216 of FIG. 2, and the previous description of delay module 216 may apply to delay modules 1016L and 1016R. Therefore, left filtered audio signal 1022L, as well as any other left filtered audio signals produced by left filter bank 1004L, may be delayed by delay time D using delay module 1016L, and right filtered audio signal 1022R, as well as any other right filtered audio signals produced by right filter bank 1004R, may also be delayed by delay time D using delay module 1016R.

Filtered audio signals 1022L and 1022R, as well as any other additional filtered audio signals produced by filter banks 1004L and 1004R, may be provided to signal event detector modules 1006L and 1006R, respectively, in addition to being delayed by delay module 1016L and 1016R, respectively. Furthermore, in some embodiments, filtered audio signals 1022L and 1022R, as well as any other additional filtered audio signals produced by filter banks 1004L and 1004R, may be provided to signal level estimation modules 1008L and 1008R at a substantially same time as they are provided to signal event detector modules 1006L and 1006R, respectively. In some embodiments, a copy of filtered audio signals 1022L and 1022R may be provided to signal event detector modules 1006L and 1006R, and a copy of filtered audio signals 1022L and 1022R may be provided to signal level estimation modules 1008L and 1008R, while the original versions of filtered audio signals 1022L and 1022R are provided to delay modules 1016L and 1016R, however this is merely exemplary. Furthermore, if filter banks 1004L and 1004R generate N filtered audio signals corresponding to N frequency bands, then each of the N filtered audio signals may be applied to a corresponding signal event detector module 1006L, 1006R, and signal level estimation module 1008L, 1008R. For example, if filter banks 1004L and 1004R split audio input signals 1002L and 1002R into three left filtered audio signals of three frequency bands (e.g., k=1, k=2, and k=3), and three right filtered audio signals of the same three frequency bands, then there may be three instances of signal event detector module 1006L and three instances of signal event detector module 1006R for each of the three left filtered audio signals and the three of the right filtered audio signals.

Signal event detector modules 1006L and 1006R, in some embodiments, may determine whether filtered audio signals 1022L and 1022R, respectively, include one or more instances of an audio event (e.g., voice, speech, sound) or a non-audio event (e.g., silence or noise). For example, each of filtered audio signals 1022L and 1022R may include one or more instances of speech, silence, or noise. Signal event detector modules 1006L and 1006R may, therefore, analyze filtered audio signals 1022L and 1022R, as well as any other filtered audio signals generated by filter banks 1004L and 1004R, to determine whether a particular filtered audio signal of a particular frequency band includes an audio event or a non-audio event. Both of signal event detector modules 1006L and 1006R may be configured similarly to signal event detector module 206 of FIG. 2, and the aforementioned description may apply. Furthermore, as filter banks 1004L and 1004R may produce N filtered audio signals corresponding to N frequency bands, each of signal event detector modules 1006L and 1006R may be configured to determine whether any of the N left filtered audio signals or the N right filtered audio signals include instances of audio events or non-audio events. In some embodiments, process 300 of FIG. 3 may be employed by signal event detector modules 1006L and 1006R to determine whether an audio frame of a filtered audio signal includes an audio event or a non-audio event.

In parallel with or after signal event detector modules 1006L and 1006R determine whether or not the left and right filtered audio signals for a particular frequency band includes an audio event or a non-audio event, a signal level estimation may be performed by signal level estimation modules 1008L and 1008R. Signal level estimation modules 1008L and 1008R, in some embodiments, may be used to determine a particular function of compressor/expander module 1010. For example, depending on the signal level estimation determined by signal level estimation modules 1008L and/or 1008R, compressor/expander module 1010 may function as a compressor, an expander, or may function with no compression effects. Compressor/expander module 1010 may then be used to determine an amount of adaptive audio gain to apply for gain smoothing by gain smoother 1012. In some embodiments, the signal level estimation and determination of whether that signal level corresponds to a compressor, expander, or linear case may be described by process 400 of FIG. 4.

In some embodiments, stereo MBDP system 1000 may include a weighted summation module 1030. Upon determining the signal level estimation for each of filtered audio signals 1022L and 1022R, the signal level estimations may be provided to weighted summation module 1030. Weighted summation module 1030 may, in the exemplary embodiment, generate an average of the signal level estimations for each frequency band, which in turn may be used by compressor/expander module 610. Weighted summation module 630 may determine the average signal level estimation using Equation 11, as described in greater detail above.

Compressor/Expander module 1010, in some embodiments, may employ process 400 of FIG. 4 to determine an amount of adaptive audio gain to use for gain smoother module 1012 based on WeightedSummation(k,n). In this way, filtered audio signals of the same frequency band across the left and right channels may receive a same amount of adaptive audio gain. In some embodiments, compressor/expander module 1010 and gain smoother module 1012 of stereo MBDP system 1000 may be substantially similar to compressor/expander module 210 and gain smoother module 212 of mono MBDP system 200 of FIG. 2, and the previous description may apply.

At block 1014L of stereo MBDP system 1000, the amount of adaptive audio gain may be applied to the delayed left audio signal(s), and at block 1014R of stereo MBDP system 600, that same amount of adaptive audio gain may be applied to the delayed right audio signal(s). Block 1014L may generate left processed audio signal 1024L for each frequency band, and block 1014R may generate right processed audio signal 1024R for each frequency band. For example, if N filtered audio signals were produced by both left filter bank 1004L and right filter bank 1004R, then block 1014L may generate N left processed audio signals, and block 1014R may generate N right processed audio signals. Each of blocks 1014L and 1014R may generate the processed audio signals for each frequency band using Equation 9. As mentioned previously, mono MBDP system 200 of FIG. 2 may include different values for factor $\alpha_k$ across the different frequency bands (e.g., for k=1, $\alpha_k=\alpha_1$; for k=2, $\alpha_k=\alpha_2$; etc.). However, for stereo MBDP system 1000, each corresponding frequency band across the different channels should have the same value for factor $\alpha_k$.

Processed audio signals 1024L and 1024R, in the illustrative embodiment, may be provided to multi-band stereo limiter 1036. Multi-band stereo limiter 1036 may, in some embodiments, be substantially similar to multi-band limiters 932*a* and 932*b* of FIG. 9, and the previous description may apply. For instance, multi-band stereo limiter 1036 may reduce or suppress peaks within processed audio signals 1024L and 1024R (or any other filtered audio signals produced by blocks 1014L and 1014R), such that system 1000 does not draw too much power from electronic device 100 and/or damages any components of electronic device 100. Multi-band stereo limiter 1036, therefore, may limit the peaks within processed audio signals 1024L and 1024R such that the amount of power drawn by an amplifier of electronic device 100, such as speaker(s) 110, is reduced, and browning-out effects do not occur.

In some embodiments, stereo MBDP system 1000 may include multiple instances of multi-band stereo limiter 1036. For example, if there are N filtered audio signals produced by filter banks 1004L and 1004R, then there should be N processed audio signals produced. Processed audio signals across different channels but of the same frequency band may, therefore, be provided to a same limiter 1036. For example, for frequency band 1 (k=1), an instance of stereo limiter 1036 for frequency band 1 may receive processed audio signals from both the left and right channels of frequency band 1, whereas for frequency band N (e.g., k==N), a different instance of stereo limiter 1036 for frequency band N may receive processed audio signals for both the left and right channels of frequency band N. Multi-band stereo limiter 1036 may generate additionally processed audio signals 1026L and 1026R (as well as any other additionally processed audio signals across either the left and right channels), which may be provided to blocks 1018L and 1018R, respectively.

At block 1018L, additionally processed audio signals 1026L may be summed together for frequency bands 1 through N to generate a left full-band output audio signal 1032L. Similarly, at block 1018R, additionally processed audio signals 1026R for frequency bands 1 through N may be summed together to generate a right full-band output audio signal 1032R. In some embodiments, additionally processed audio signals 1026L and 1026R may include N different processed audio signals corresponding to N different frequency bands. For example, additionally processed audio signal 1026L may include additionally processed audio signal 1028*a* corresponding to frequency band k=1 up to additionally processed audio signal 1028*b* corresponding to frequency band k=N. Similarly, additionally processed audio signal 1026R may include additionally processed audio signal 1028*c* corresponding to frequency band k=1 up to additionally processed audio signal 1028*d* corresponding to frequency band k=N. Although only two processed audio signals corresponding to a first frequency band and an N-th frequency band are shown for both the left and right channel, persons of ordinary skill in the art will recognize that additionally processed audio signals 1026L and 1026R may be representative of any number of additionally processed audio signals, and the aforementioned is merely illustrative. Full-band output audio signals 1032L and 1032R, in some embodiments, may be generated using Equation 10.

In some embodiments, full-band output audio signals 1032L and 1032R may then be applied to stereo limiter block 1020. Stereo limiter block 1020 may correspond to any suitable audio limiter for preventing amplitude peaks in audio signals from exceeding positive and negative maximum amplitude limits. Limiter 1020 may be configured to reduce an amount of total harmonic distortion present within full-band audio output signals 1032L and 1032R such that final audio output signals 1034L and 1034R have a reduced amount of the total harmonic such that no damage to any components of electronic device 100 (e.g., speakers 210), may occur. In some embodiments, stereo limiter block 1020 may be substantially similar to limiter block 620 of stereo MBDP system 600 of FIG. 6, and the previous description may apply.

The various embodiments of the invention may be implemented by software, but may also be implemented in hardware, or in a combination of hardware and software. The invention may also be embodied as computer readable code on a computer readable medium. The computer readable medium may be any data storage device that may thereafter be read by a computer system.

The above-described embodiments of the invention are presented for purposes of illustration and are not intended to be limiting. Although the subject matter has been described in language specific to structural feature, it is also understood that the subject matter defined in the appended claims is not necessarily limited to the specific features described. Rather, the specific features are disclosed as illustrative forms of implementing the claims.

What is claimed is:

1. A method for reducing intermodulation distortion, comprising:

receiving audio input data;

generating at least one first audio signal by splitting the audio input data into at least one frequency band;

generating, for the at least one first audio signal, at least one delayed audio signal that is delayed by a delay time;

determining, based on an energy of an audio frame being greater than an audio event threshold value, that the audio frame comprises an audio event;

determining, based on a signal energy level of the audio frame being one of: less than a first threshold signal energy level, greater than a second threshold signal energy level, or less than the second threshold signal energy level and greater than the first threshold signal energy level, a gain for the at least one first audio signal;

generating at least one second audio signal by multiplying the gain and the at least one delayed audio signal; and generating an audio output signal by summing the at least one second audio signal across the at least one frequency band.

2. The method of claim 1, further comprising:

providing, prior to generating the audio output signal, the at least one second audio signal to a limiter to remove any audio clipping events from the at least one second audio signal.

3. The method of claim 1, wherein determining that the audio frame comprises the audio event comprises:

determining the energy;

determining an energy envelope of the at least one audio frame;

determining an energy minimum of the energy envelope;

determining a product of the energy minimum and an energy ratio threshold value; and determining that the energy envelope is greater than the product.

4. The method of claim 1, further comprising:

determining the signal energy level based on the energy;

determining the first threshold signal energy level corresponding to the gain increasing an intensity of the at least one delayed audio signal; and determining the second threshold signal energy level corresponding to the gain decreasing the intensity of the at least one delayed audio signal.

5. The method of claim 1, wherein receiving the audio input data comprises receiving left channel audio input data, the method further comprises:

receiving right channel audio input data;

generating at least one left channel audio signal by splitting the left channel audio input data into the at least one frequency band;

generating at least one right channel audio signal by also splitting the right channel audio input data into the at least one frequency band;

generating at least one left channel delayed audio signal for the at least one left channel audio signal;

generating at least one right channel delayed audio signal for the at least one right channel audio signal; and determining that one of the at least one left channel audio signal or the at least one right channel audio signal comprises the audio frame.

6. The method of claim 5, further comprising:

generating a weighted summation of the at least one left channel audio signal and the at least one right channel audio signal, wherein determining the gain comprises determining the gain for the weighted summation.

7. The method of claim 1, further comprising:

generating at least one modified audio signal by applying a predefined sampling rate reduction factor to the at least one first audio signal prior to determining the gain, wherein determining the gain amount comprises determining the gain for the at least one modified audio signal; and generating at least one restored audio signal by applying a predefined sampling rate increase factor to the at least one modified audio signal prior to the at least one second audio signal being generated, wherein generating the audio output signal comprises summing the at least one restored audio signal across the at least one frequency band.

8. The method of claim 1, wherein determining the gain further comprises:

determining a first gain;

determining a second gain based on at least one of: the first gain and a user adjustable gain;

determining a gain smoothing factor; and generating the gain based, at least in part, on the second gain and the gain smoothing factor.

9. An electronic device, comprising:

at least one audio output device;

memory; and at least one processor configured to:

receive audio input data;

generate at least one first audio signal by splitting the audio input data into at least one frequency band;

generate, for the at least one first audio signal, at least one delayed audio signal that is delayed by a delay time;

determine, based on an energy of an audio frame being greater than an audio event threshold value, that the audio frame comprises an audio event;

determine, based on a signal energy level of the audio frame being one of: less than a first threshold signal energy level, greater than a second threshold signal energy level, or less than the second threshold signal energy level and greater than the first threshold signal energy level, a gain for the at least one first audio signal;

generate at least one second audio signal by multiplying the gain and the at least one delayed audio signal; and generate an audio output signal by summing the at least one second audio signal across the at least one frequency band.

10. The electronic device of claim 9, wherein the at least one processor is further configured to:

provide, prior to generating the audio output signal, the at least one second audio signal to a limiter to remove any audio clipping events from the at least one second audio signal.

11. The electronic device of claim 9, wherein the at least one processor is further configured to:

determine the energy;

determine an energy envelope of the at least one audio frame;

determine an energy minimum of the energy envelope;

determine a product of the energy minimum and an energy ratio threshold value; and determine that the energy envelope is greater than the product.

12. The electronic device of claim 9, wherein the at least one processor is further configured to:

determine the signal energy level based the energy;

determine the first threshold signal energy level corresponding to the gain increasing an intensity of the at least one delayed audio signal; and determine the second threshold signal energy level corresponding to the gain decreasing the intensity of the at least one delayed audio signal.

13. The electronic device of claim 9, wherein the audio input data comprises left channel input audio data, the at least one processor is further configured to:

receive right channel audio input data;

generate at least one left channel audio signal by splitting the left channel audio input data into the at least one frequency band;

generate at least one right channel audio signal by splitting the right channel audio input data into the at least one frequency band;

generate at least one left channel delayed audio signal for the at least one left channel audio signal;

generate at least one right channel delayed audio signal for the at least one right channel audio signal; and determine that one of the at least one left channel audio signal or the at least one right channel audio signal comprises the audio frame.

14. The electronic device of claim 13, wherein the at least one processor is further configured to:

generate a weighted summation of the at least one left channel audio signal and the at least one right channel audio signal, wherein the gain is determined using the weighted summation.

15. The electronic device of claim 9, wherein the at least one processor is further configured to:

generate at least one modified audio signal by applying a predefined sampling rate reduction factor to the at least one first audio signal prior to determining the gain, wherein the gain is determined for the at least one modified audio signal; and generate at least one restored audio signal by applying a predefined sampling rate increase factor to the at least one modified audio signal prior to the at least one second audio signal being generated, wherein the audio output signal is generated by summing the at least one restored audio signal across the at least one frequency band.

16. The electronic device of claim 9, wherein the at least one processor is further configured to:

determine a first gain;

determine a second gain based on at least one of: the first gain and a user adjustable gain;

determine a gain smoothing factor; and generate the gain based, at least in part, on the second gain and the gain smoothing factor.

17. The method of claim 1, wherein determining the gain for the at least one first audio signal comprises:

determining that the signal energy level of the audio frame is less than the second threshold signal energy level and greater than the first threshold signal energy level; and determining that the gain is equal to a user adjustable gain, the user adjustable gain being greater than zero.

18. The method of claim 1, wherein determining the gain for the at least one first audio signal comprises:

determining that the signal energy of the audio frame is one of: less than the first threshold energy level or greater than a second threshold signal energy level; and determining that the gain is equal to a first gain multiplied by a user adjustable gain, wherein the first gain corresponding to a base value raised to a first exponential, the first exponential being determined based, at least in part, on a first compression ratio, a first knee-width, and the signal energy level.

19. The electronic device of claim 9, wherein the gain being determined corresponds to the at least one processor being further configured to:

determine that the signal energy level of the audio frame is less than the second threshold signal energy level and greater than the first threshold signal energy level; and determine that the gain is equal to a user adjustable gain, the user adjustable gain being greater than zero.

20. The electronic device of claim 9, wherein the gain being determined corresponds to the at least one processor being further configured to:

determine that the signal energy of the audio frame is one of: less than the first threshold energy level or greater than a second threshold signal energy level; and determine that the gain is equal to a first gain multiplied by a user adjustable gain, wherein the first gain corresponding to a base value raised to a first exponential, the first exponential being determined based, at least in part, on a first compression ratio, a first knee-width, and the signal energy level.

* * * * *